US007479937B2

(12) United States Patent
Shimoda

(10) Patent No.: US 7,479,937 B2
(45) Date of Patent: Jan. 20, 2009

(54) SEMICONDUCTOR DEVICE FOR DRIVING CURRENT LOAD DEVICE, AND DISPLAY DEVICE

(75) Inventor: Masamichi Shimoda, Tokyo (JP)

(73) Assignees: NEC Corporation, Tokyo (JP); NEC Electronics Corporation, Kanagawa (JP)

( * ) Notice: Subject to any disclaimer, the term of this patent is extended or adjusted under 35 U.S.C. 154(b) by 788 days.

(21) Appl. No.: 10/983,264

(22) Filed: Nov. 8, 2004

(65) Prior Publication Data

US 2005/0104819 A1 May 19, 2005

(30) Foreign Application Priority Data

Nov. 7, 2003 (JP) ..... 2003-378458

(51) Int. Cl.
*G09G 3/12* (2006.01)
*G09G 3/30* (2006.01)

(52) U.S. Cl. ..... 345/76; 345/77; 345/204; 315/169.3

(58) Field of Classification Search ..... 345/76–84, 345/204, 214–215; 315/169.1, 169.3
See application file for complete search history.

(56) References Cited

U.S. PATENT DOCUMENTS

| | | | | |
|---|---|---|---|---|
| 6,501,449 | B1 | 12/2002 | Huang | |
| 2003/0020413 | A1* | 1/2003 | Oomura | 315/169.3 |
| 2003/0151374 | A1 | 8/2003 | Maede et al. | |
| 2005/0075208 | A1* | 4/2005 | Holmsen | 475/149 |

FOREIGN PATENT DOCUMENTS

| | | |
|---|---|---|
| CN | 1402212 | 3/2003 |
| JP | 2000-293245 | 10/2000 |
| JP | 2003-187988 | 7/2003 |
| WO | WO 03/077230 | 9/2003 |

OTHER PUBLICATIONS

K. Abe, M. Shimoda, H. Haga, H. Asada, and H. Hayama, Functional Devices Research Laboratories, NEC Corp., K. Iguchi, D. Iga, Y. Iketsu, H. Imura, and S. Miyano, Display Device Division, NEC Electron Devices, 16-1: a Poly-Si TFT 6-bit Current Data Driver for Active Matrix Organic Light Emitting Diode Displays Eurodisplay 2002 pp. 279,280,281, and 282.

* cited by examiner

*Primary Examiner*—David L Lewis
(74) *Attorney, Agent, or Firm*—Young & Thompson

(57) ABSTRACT

A semiconductor device driving a current load device includes a constant current circuit with six V-I conversion circuit blocks, each including current mirror and V-I conversion circuits and output a current different from a current from other V-I conversion circuit blocks. In the current mirror, first and second transistor sources are connected to a power source. Gates of first and second transistors are connected to a the first transistor drain. The second transistor source is an output. In the VI conversion circuit, a current control voltage is input into a non-inversion input of an operational amplifier, an inversion input of the operational amplifier connects to one terminal of a variable resistor with the other grounded. An output of the operational amplifier is connected to the third transistor gate. The third transistor drain is connected to the first transistor drain. The source is connected to one terminal of the variable resistor.

21 Claims, 17 Drawing Sheets

| | OFFSET CANCEL PERIOD | NORMAL OPERATIONAL AMPLIFIER OPERATION PERIOD |
|---|---|---|
| SW1, SW2 | ON | OFF |
| SW1, SW4 | OFF | ON |

| | | |
|---|---|---|
| OPERATION MODE FOR CIRCUIT 53A | CURRENT STORING PERIOD | CURRENT OUTPUT PERIOD |
| OPERATION MODE FOR CIRCUIT 53B | CURRENT OUTPUT PERIOD | CURRENT STORING PERIOD |
| SW51, SW52, SW56 | ON | OFF |
| SW53, SW54, SW55 | OFF | ON |

| | | |
|---|---|---|
| OPERATION MODE FOR CIRCUIT 73A | CURRENT STORING UNIT | CURRENT OUTPUT UNIT |
| OPERATION MODE FOR CIRCUIT 73A | CURRENT OUTPUT UNIT | CURRENT STORING UNIT |
| SW71, SW72, SW76 SW77 | ON | OFF |
| SW73, SW74, SW75 SW78 | OFF | ON |

SEMICONDUCTOR DEVICE FOR DRIVING CURRENT LOAD DEVICE, AND DISPLAY DEVICE

BACKGROUND OF THE INVENTION

1. Field of the Invention

The present invention relates to a semiconductor device for driving a current load device that supplies current to a current-driven element such as an organic electroluminescent element, and a display device having the same. In particular, the present invention relates to a semiconductor device with a constant current circuit, and a display device.

2. Description of the Related Art

An organic EL (Electro-Luminescence) display device has organic EL elements that are self-emitting and have a fast light-emitting response, and has features such as thin, light-weight, a wide viewing angle, and excellent moving image display functionality. FIG. 1 is a block diagram illustrating the configuration of an organic EL display device. As illustrated in FIG. 1, with a passive matrix (PM) type organic EL display device, each pixel 101 in a display unit 100 comprises an organic EL element 110 and wiring such as a scanning line 112 and a data line 111, and with an active matrix (AM) type organic EL display device, each pixel 101 in a display unit 100 is formed with a pixel circuit 113 that supplies current to the organic EL element 110, in addition to the organic EL element 110 and wiring such as the scanning line 112 and the data line 111.

Such organic EL display device performs a horizontal scan that selects organic EL elements 110 or pixel circuits 113 on each line, according to the signal from a horizontal scan circuit 103. Then, for the period that is line-selected, appropriate voltage or current is supplied to each organic EL element 110 or each pixel circuit 113 on the selected line via each data line 111 from each output of the organic EL display device drive circuit. The current to flow to the organic EL element 110 is determined based on the supplied voltage or current, and the illumination brightness of the organic EL element 110 is adjusted and the image is displayed. Therefore, the illumination brightness of the organic EL element 110 is determined by the applied voltage value or the supplied current value to the organic EL element 110. Also, a linear relationship exists between the illumination brightness and the supplied current with regards to the organic EL element 110, and a non-linear relationship exists between the illuminating brightness and the applied voltage.

Conventional organic EL elements have the problem that elements deteriorate as the light emission time elapses, and the brightness corresponding to the applied voltage decreases as the light emission time elapses. However, since the time variation of brightness corresponding to the supplied current is smaller than the time variation of brightness corresponding to applied voltage, a drive method that supplies current to the organic EL element can maintain a higher display quality than a method that applies voltage to the organic EL element.

In order to suppress deterioration in display quality of the above-described AM-type organic EL display device, it is important that the current supplied from the driving transistor that is provided to the pixel circuit 133 and supplies current to the organic EL element 110 is according to the design thereof, even in the case that the current properties of the driving transistor in each pixel 101 differs from each other. FIG. 2 is a circuit diagram illustrating a voltage-write and current-drive type pixel circuit. The pixel circuit 133*a* of the voltage-write and current-drive type illustrated in FIG. 2 is supplied with voltage from an external drive circuit via a data line 111.

In the case that properties of the driving transistor 114 in the pixel circuit 133*a* vary from one pixel to another, the current provided to the organic EL Element 110 also varies from one pixel to another, and the light emission brightness of the organic EL element 110 also varies from one pixel to another. In the event that the light emission brightness of the organic EL element 110 differs from one pixel to another, non-uniformity is generated in the display image, and therefore display quality deteriorates.

On the other hand, a pixel circuit of the current-write and current-drive type is supplied with current from an external drive circuit via a data line 111. FIG. 3 is a circuit diagram illustrating a current-write and current-drive type pixel circuit. With the pixel circuit 113*b*, in the state that short has occurred between the gate and drain of the driving transistor 114 by the control line 115, in other words, in the state that the switches 117 through 119 are on (continuity), the current supplied by the data line 111 is stored, and next, without the switches 117 through 119 on, the switch 120 conducts by the control line 116, and the stored current flows to the organic EL element. Thus, by providing a current copier circuit to the pixel circuit, current recording and current output can both be performed with one driving transistor, and therefore, changes of the supply current to the organic EL element due to the irregularities of the driving transistor properties can be reduced, and display quality can be improved.

A drive circuit for outputting the current capable of corresponding to the current-write and current-drive type pixel circuit 113*b* illustrated in FIG. 3 might be a drive circuit that current copier circuits are provided in a number according to the gradient (for example, reference K. Abe et al., "16-1: A Poli-Si TFT 6-bit Current Data Driver for Active Matrix Organic Light Emitting Diode Displays", EURODISPLAY 2002 Proceeding, pp. 279-281). FIG. 4 is a block diagram illustrating the operation of a drive circuit described in K. Abe et al., "16-1: A Poli-Si TFT 6-bit Current Data Driver for Active Matrix organic Light Emitting Diode Displays", EURODISPLAY 2002 Proceeding, pp. 279-281. As illustrated in FIG. 4, the drive circuit 128 provides the same number of current copier circuits as the type of reference current supplied from the reference current source 127. In other words, in the case wherein n (wherein n is a natural number) types of reference current is output from the reference current source 127, the drive circuit is provided with n number of current copier circuits. Also, these n numbers of current copier circuits are connected in parallel. The drive circuit 128 has a current recording state and a current output state, and during the current recording state, a reference current i is supplied to the output transistor 121 of the current copier circuit in the state that short has occurred between the gate and drain from the reference current source 127, and the gate voltage of the output transistor 121 at this time (the voltage corresponding to the reference current i) is recorded with the capacitor 129. On the other hand, during the current output state, short-circuiting between the gate and drain of the output transistor 121 is resolved, and by inputting voltage that corresponds to the reference current i of the output transistor 121 from the capacitor 129, the same size current as the reference current i can be output from the output transistor 121.

Therefore, with regard to the drive circuit 128, reference currents which are different each other are supplied to current copier circuits respectively, and the reference current is recorded in each current copier circuit. Then while placing the drive circuit 128 in a current output state, the presence or absence of current output from each current copier circuit can be determined by turning the switch element 130 provided to each current copier circuit on state or off (no continuity) state according to the display digital data input from an external unit. In this manner, by combining the current output from each current copier circuit within the drive circuit 128, the predetermined current can be output from the drive circuit. For example, in the case that three current copier circuits are provided to the drive circuit 128, and each current copier circuit is supplied with three types of reference current i0 through i2 that the current ratio each differs twofold, each current copier circuit will output three types of reference current i0 through i2 that the current ratio each differs twofold. Then, by combining the on or off state of the switch elements 130 provided to each current copier circuit, the output current i0 through i2 is combined, and including the case that the current is 0, eight types of current can be output. Now, the drive circuit 128 is provided for each data line 131 that is provided to the display unit, and the output current from each drive circuit 128 is supplied to the pixel circuit via the data line 131.

Further, Japanese Unexamined Patent Application Publication No. 2000-293245 proposes a constant current circuit supplying multiple reference currents that store appropriate current ratios, as a reference electric power supply source for outputting reference current to the drive circuit. FIG. 5 is a circuit diagram illustrating a constant current circuit described in Japanese Unexamined Patent Application Publication No. 2000-293245. As illustrated in FIG. 5, the constant current circuit has a circuit configuration that can generate multiple reference currents for a drive circuit for an organic EL display device, and comprises an operational amplifier 122 such as a CMOS operation amplifier, a V-I conversion unit 124 that is formed from a transistor Tr101 and a resistor 123 which the resistance value is Rc, and a current mirror circuit unit 125 that is formed from a mirror transistor Tr102 and current source transistors Tr103 through Tr105.

The V-I conversion unit 124 of this constant current circuit operates so as to output the current i (=Vin/Rc) found by dividing the voltage Vin input into the non-inversion input terminal of the operational amplifier 122 by the resistance value Rc of the resistor element 123, to the transistor Tr101, Tr102, and the resistor 123. At this time, the voltage between the gate and source of the transistors Tr102 through Tr105 in the current mirror circuit unit 125 are equal with each other, and therefore the three current source transistors Tr103 through Tr105 output a current determined by: the current capability ratio to the mirror transistor Tr102, and the current flowing to the mirror transistor Tr102. Therefore, for example, in the case that the channel length of three transistors Tr103 through Tr105 is made the same as the channel length of the mirror transistor Tr102, and the channel width is made equal to, double, and quadruple, respectively compared to the channel width of the mirror transistor Tr102, then the current i1 through i3 output from the current source transistor Tr103 through Tr105 will be equal to, double, and quadruple, respectively, of the current i (=Vin/Rc) that flows to the mirror transistor Tr2.

However, the above-described related art has problems, which will be described below. The output current in the constant current circuit described in Japanese Unexamined Patent Application Publication No. 2000-293245 is determined by the ratio of the current capability of the mirror transistor Tr102 and the current capability of the current source transistors Tr103 through Tr105, but even if the current capability ratio of each transistor is set by changing the channel width of the current source transistors Tr103 through Tr105, the current capability may not be according to design, due to the manufacturing process and so forth. In this case, because the current source transistor outputs a current that differs from the specified current ratio, a problem occurs wherein the accuracy of the output current of the drive circuit generated based on this output current decreases.

In particular, low temperature poly-crystal silicon thin film transistors (LTPS TFT) and amorphous silicon thin film transistors (a-Si TFT) and so forth have greater irregularities of current properties, and when a constant current circuit is formed using these transistors, the deterioration in accuracy becomes greater.

Therefore, a constant current circuit has been device that the output current ratio irregularities due to the transistor property irregularities can be adjusted, by providing multiple current mirror circuits, and adjusting the input voltage for each circuit. FIG. 6 is a circuit diagram illustrating a conventional constant current circuit that is capable of adjusting the output current ratio. The constant current circuit 126 has six circuit blocks I0 through I5 with differing output currents connected with each other in parallel. And the circuit block 10 has the source terminals of the P-type transistor Tr121_I0 and transistor Tr122_I0 connected to the source electrode VDD, and while gate terminals of transistor Tr121_I0 and transistor Tr122_I0 are connected to each other and connected to the drain terminal of the transistor Tr101_I0, and the first date terminal is connected to an external source, and the source terminal is connected to a ground electrode GND. Further, the drain terminal of the transistor Tr122_I0 becomes the output terminal. The circuit blocks I1 through I5 in the constant current circuit 126 the same as the circuit block I0, except in the cases that the channel width of the transistor is a width corresponding to an output current ratio, for example, two, four, eight, sixteen, or thirty-two times the channel width of the transistor provided to the circuit block I0.

The constant current circuit 126 has power source potential applied to the power source electrode VDD, and the negative power source potential is applied to the ground electrode GND, and at the same time, the voltage VR is input into the gate terminal of the transistor TR123 from an external power source. By doing so, a current i0 corresponding to the voltage VR0 is generated with the transistor Tr123 within the circuit block I0. This current i0 flows to the transistor Tr121 that is connected to the transistor Tr123. Further, since a size and a voltage between the gate and the source of a transistor Tr122 is equal to those of the transistor Tr121, the same current i0 flows also to the transistor Tr122. Thus, the current i0 is output from the circuit block I0. The operation of circuit blocks I1 through I5 are also the same as those that of circuit block I0, therefore in the case that the transistor properties have no irregularities, the current i0 through i5 can be output at the predetermined ratio by making the input voltage VR0 through VR5 equal, for example, i0:i1:i2:i3:i4:i5=1:2:4:8:16:32. However, in the event that the properties of the transistors Tr121, Tr122, and Tr123 are irregular, the current ratio as designed cannot be obtained, and therefore with the constant current circuit 126, the input voltage VR0 through VR5 is adjusted so that the current i0 through i5 becomes the designed value.

In general, the semiconductor device for driving a current load device of a display element such as an organic EL element have this type of constant current circuit provided for each of R, G, and B, and after adjusting the current ratio within the constant current circuits, the balance between the reference current output from the circuits and the RGB (white balance) is adjusted. In the constant current circuit 126 illustrated in FIG. 6, since the adjustment of this reference current and the white balance is performed by adjusting the input voltage VR0 through VR5, problems exist that the current ratio of currents i0 through i5 can easily differ from the designed value, and the reference current and the white balance become difficult to adjust while holding at this current ratio.

SUMMARY OF THE INVENTION

Accordingly, it is an object of the present invention to provide a semiconductor device for driving a current load device and a display device having the same, wherein current can be output at a high degree of accuracy even in the event that the transistor properties are irregular, and adjustments to the output reference current can be made easily.

According to an aspect of the present invention, semiconductor device for driving a current load device comprises: a cell having one or a plurality of current load elements; one or a plurality of constant current circuits that output n (wherein n is a natural number) types of reference currents, each of the constant current circuit having an n number of voltage-current conversion circuits, which input a current control voltage and output the reference current corresponding to the current control voltage, the current control voltage being the same as the current control voltage which is input to the voltage-current conversion circuits which belong to the same constant current circuit; and one or a plurality of drive circuits that output the current based on the reference current output from each of the constant current circuit to the cell.

According to the present invention, current adjusting for each constant current circuit can be made by providing n number of voltage-current conversion circuits on the constant current circuit, thereby variation in the current output that results from the transistor properties irregularities is restrained, and multiple currents can be output with a high degree of accuracy. Further, since a common current control voltage is input into all of the voltage-current conversion circuits within the constant current circuit, increasing/decreasing of all of the output currents can easily be performed while holding the current ratio output from the n number of voltage-current conversion circuits within the constant current circuits. As a result, by providing the constant current circuit for every color of the display unit of the display device, the brightness adjustment for each color and the white balance adjustment become easier.

The voltage-current conversion circuit may comprise, for example, a transistor, a resistor in which a reference potential is applied to the one terminal of the resistor and the other terminal is connected to the transistor, and an operational amplifier having one pair of input terminals to one of which the current control voltage is input and to the other of which is connected to the other terminal of the resistor, and an output terminal connected to the gate of the transistor, wherein the current control voltage is input to the operational amplifier, and a current based on the current control voltage and the resistance value of the resistor is output from the transistor.

Further, the voltage-current conversion circuit may have a current mirror circuit, with the reference current being output from the current mirror circuit. Thus, the reference current can be output with a high degree of accuracy due to not being readily affected by external noise and so forth.

Further, the voltage-current conversion circuit may further comprise, for example, a transistor for providing current to the current mirror circuit, a resistor in which the one terminal of the resistor is connected to a ground and the other terminal is connected to the transistor, an operational amplifier having one pair of input terminals to one of which the current control voltage is input and to the other of which is connected to the other terminal of the resistor, and an output terminal connected to the gate of the transistor, wherein the current control voltage is input into the operational amplifier, and a current based on the current control voltage and the resistance value of the resistor is supplied to the current mirror circuit from the transistor.

Alternatively, the voltage-current conversion circuit may further comprise, for example, a resistor in which the one terminal of the resistor is connected to a ground and the other terminal is connected to the current mirror circuit, and an operational amplifier having one pair of input terminals to one of which the current control voltage is input and to the other of which is connected to the other terminal of the resistor, and an output terminal connected to the gate of the current mirror circuit, wherein the current control voltage is input into the operational amplifier, and a current based on the the current control voltage and the resistance value of the resistor flows to the current mirror circuit.

The resistors may be variable resistors, and by changing the value of these variable resistors, the reference current that is output from the blocks may be adjusted. Thus, the reference current ratio output from the blocks can be easily adjusted.

Further, an offset cancel circuit for correcting the offset voltage of the input can be provided to the operational amplifier. Thus, for example, by combining the operational amplifier wherein is provided an offset cancel circuit, and resistance with high absolute accuracy, the multiple constant current outputs with the predetermined current ratio can be output without performing adjustment. As a result, a lower-priced display device can be realized by simplifying the work process. Further, in the case that resistors are provided that have poor absolute accuracy but good relative accuracy, the output current as designed can be obtained, simply by adjusting the input voltage. In other words, adjusting the current ratio is not necessary, and since only the white balance needs to be adjusted, the work for adjusting the current ratio can be omitted.

Further, regarding the current mirror circuit, a cascode type current mirror circuit is preferred. Thus, a constant current output can be obtained even in the event that power source fluctuation and current load fluctuation occur, and therefore current output with a higher degree of accuracy can be obtained.

On the other hand, the voltage-current conversion circuit has a current copier circuit, and the reference current can be output from the current copier circuit. Thus, the transistor provided within the current copier circuit performs the two operations of current storing and current output, and therefore the transistor property irregularities do not influence the output current, and multiple currents can be output with a high degree of accuracy.

The voltage-current conversion circuit may further comprise, for example, a transistor for providing current to the current copier circuit, a resistor in which the one terminal of the resistor is connected to a ground and the other terminal is connected to the transistor, and an operational amplifier having one pair of input terminals to one of which the current control voltage is input and to the other of which is connected to the other terminal of the resistor, and an output terminal connected to the gate of the transistor, wherein the current control voltage is input into the operational amplifier, and a current based on each of the current control voltage and the resistance value of the resistor is supplied to the current copier circuit from the transistor.

Alternatively, the voltage-current conversion circuit further comprises, for example, a resistor in which the one terminal of the resistor is connected to a ground and the other terminal is connected to the current copier circuit, and an operational amplifier having one pair of input terminals to one of which the current control voltage is input and to the other of which is connected to the other terminal of the resistor, and an output terminal connected to the gate of the current copier circuit, wherein the current control voltage is input into the operational amplifier, and a current based on the current control voltage and the resistance value of the resistor flows to the current copier circuit.

The resistors may be variable resistors, and by changing the value of these variable resistors, the reference current that is output from each block can be adjusted. Further, an offset cancel circuit for correcting the offset voltage of the input can be provided to the operational amplifier.

Further, one pair of current copier circuits are provided to the voltage-current circuit, and this pair of current copier circuits can perform a current recording operation and a current output operation alternately after every set time period. Thus, current output operations can be performed constantly.

Further, regarding the current copier circuit, a cascode type current copier circuit is preferred. Thus, a constant current output can be obtained even in the event that power source fluctuation and current load fluctuation occur, and therefore current output with a higher degree of accuracy can be obtained.

The current load device used in a semiconductor device for driving a current load device may be an organic EL element, for example.

The display device relating to the present invention may use an organic EL element as the current load device, having the above-described semiconductor device for driving a current load device. With the present invention, current can be output from the semiconductor device for driving a current load device to the current load device with a high degree of accuracy without display irregularities, therefore, and high quality images can be displayed. Also, by providing the constant current circuit for the configuration for each color of the display unit, adjusting the white balance becomes easier.

According to the present invention, by providing n number of V-I conversion circuits on the constant current circuit of the semiconductor device for driving a current load device, n types of reference currents can be output with good accuracy, even in the event that the properties of the transistors provided within the circuit have irregularities, and additionally, by providing the current circuits for each color configured on the display unit of the light-emitting display device such as an organic EL display device, and by inputting a common voltage to all of the V-I conversion circuits within each of the constant current circuits, increase/decrease of the reference current and adjustment of the white balance can be performed easily.

DESCRIPTION OF THE PREFERRED EMBODIMENTS

A semiconductor device for driving a current load device relating to the embodiments of the present invention will be described in detail below while referencing the attached drawings.

First Embodiment

Figure 7:
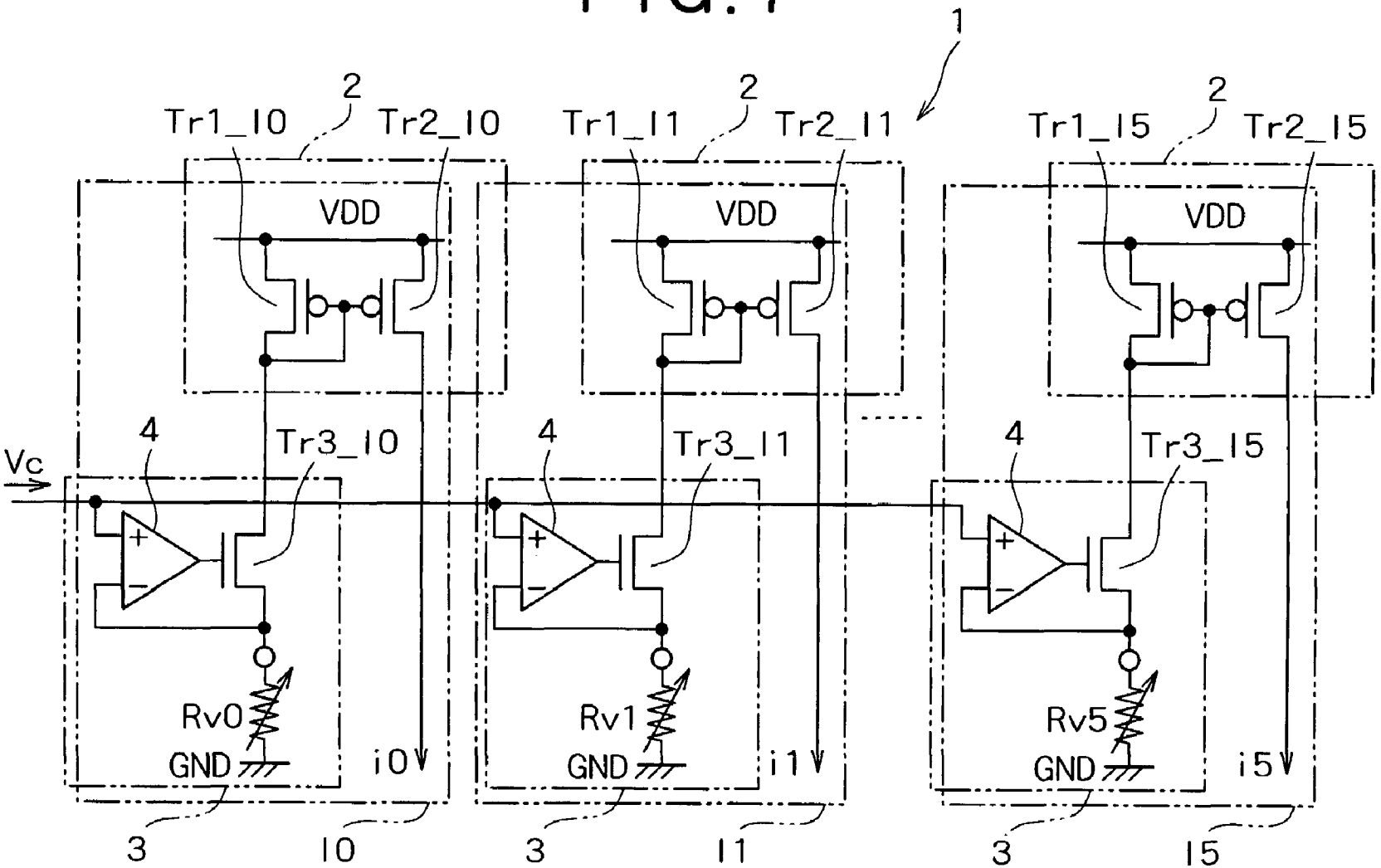
FIG. 7 is a circuit diagram illustrating a constant current circuit provided to the semiconductor device for driving a current load device according to a first embodiment of the present invention.

First, a semiconductor device for driving a current load device according to a first embodiment of the present invention will be described. The semiconductor device for driving a current load device according to the present embodiment comprises a drive circuit and a constant current circuit for outputting the reference current into the drive circuit, and is a semiconductor device that supplies current to the current-drive type elements such as organic EL elements. FIG. 7 is a circuit diagram illustrating a constant current circuit provided to the semiconductor device for driving a current load device according to the present embodiment. As illustrated in FIG. 7, the constant current circuit 1 includes circuit blocks I0 through I5, which are V-I (voltage-current) conversion circuits and connected to each other in parallel. These six V-I conversion circuit blocks I0 through I5 are provided with a current mirror circuit unit 2 and a V-I conversion unit 3, and output different currents respectively.

Two P-type transistors, transistor Tr1_I0 and transistor Tr2_I0, are provided to the current mirror circuit 2 of the V-I conversion circuit block I0, and an operational amplifier 4, an N-type transistor Tr_3I0, and variable resistors Rv that are capable of adjusting the resistance value r, are provided to the V-I conversion unit 3. Also, the source terminals of the transistor Tr1_I0 and transistor Tr2_I0 are connected to the power source electrode VDD, and the gate terminals are connected to each other as well as being connected to the drain terminal of the transistor Tr1_I0. The drain terminal of this transistor Tr1_I0 is connected to the drain terminal of the transistor Tr3_I0, and the source terminal of the transistor Tr3_I0 is connected to the other terminal of the variable resistor Rv which the terminal on one side is connected to a ground electrode GND. Further, a current control voltage Vc is input into the non-inversion terminal of the operational amplifier 4, and the non-inversion terminal is connected to the other terminal of the variable resistor Rv, and the output terminal is connected to the gate terminal of the transistor Tr3_I0. Also, the source terminal of the transistor Tr2_I0 becomes the output terminal of the constant current. The current configuration and connections of the V-I conversion circuit blocks I1 through 15 within this constant current circuit 1 are the same as those of the above-described V-I conversion circuit blocks I0. Now, in the case that the semiconductor device for driving a current load device according to the present embodiment is provided to an organic EL display device, the portion other than the variable resistors Rv is provided to a glass plate that forms the display unit, and the variable resistors Rv are provided to a portion other than the display unit.

Next, the size of the transistor of the constant current circuit 1 according to the present embodiment will be described. The P-type transistors Tr1 and Tr2 within the same circuit block have the same channel length L and channel width W, and therefore, the current ratio within the current mirror circuit 2 is 1. Further, in the case of different circuit blocks, the channel width W of the transistors Tr1 and Tr2 differ from one another, and with the channel width W of the transistor Tr1 as WTr1, and the channel width W of the transistor Tr2 as WTr2, the ratio thereof is WTr1_I0:WTr1_I1: WTr1_I2:WTr1_I3: WTr1_I4:WTr1_I5=WTr2_I0: WTr2_I1: WTr2_I2: WTr2_I3: WTr2_I4 WTr2_I5=1:2:4:8:16:32. Now, the channel length L of the transistors Tr1 and Tr2 are the same for all circuit blocks.

On the other hand, the channel width WTr3 of the N-type transistor Tr3 of the V-I conversion unit 3 is WTr3_I0: WTr3_I1:WTr3_I2:WTr3_I3:WTr3_I4:WTr3_I5=1:2:4:8:16:32. Now, the channel length L of the transistor Tr3 is the same for all circuit blocks.

Figure 8:
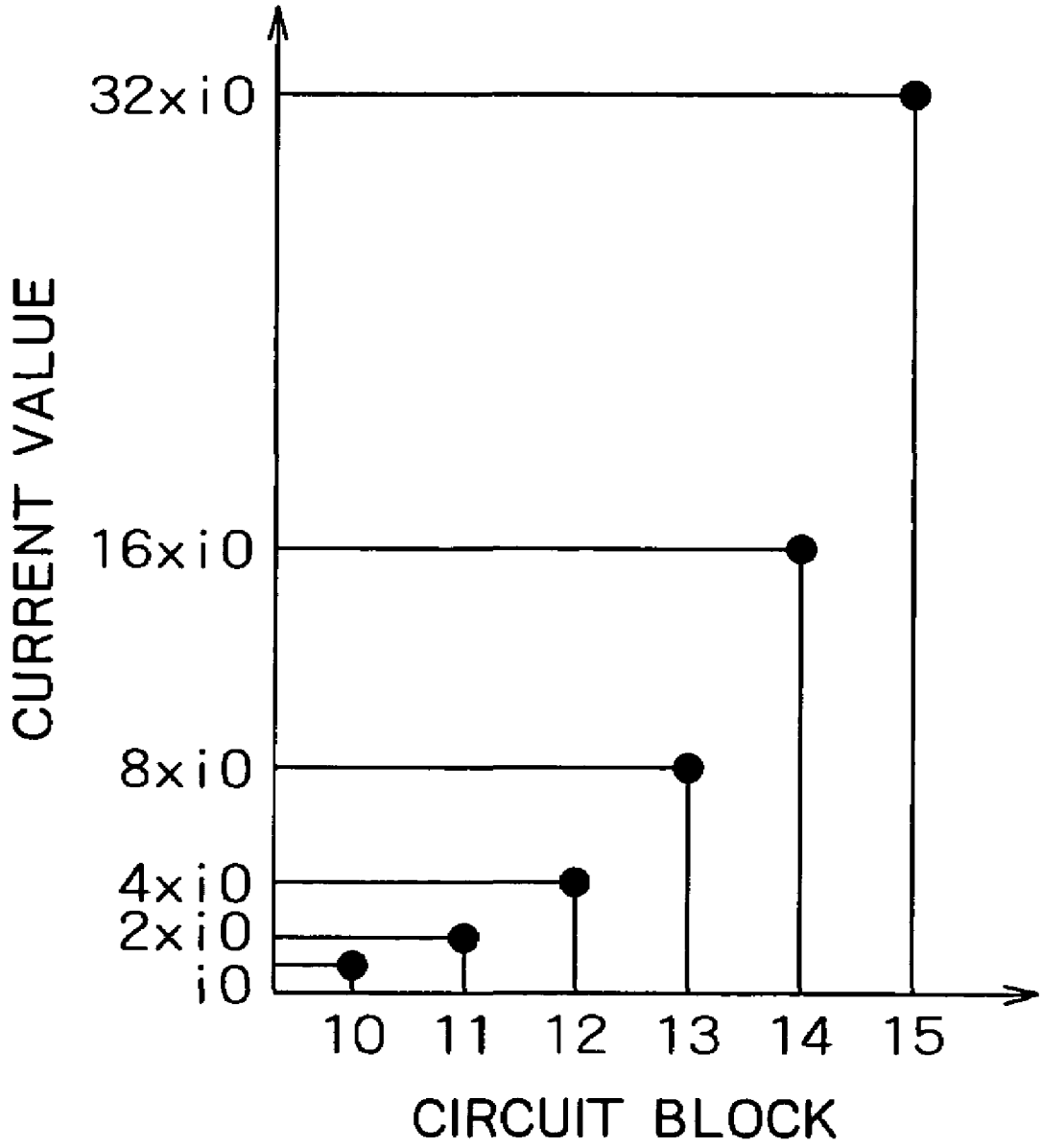
FIG. 8 is a diagram illustrating the reference current value output from the constant current circuit provided to the semiconductor device for driving a current load device according to the first embodiment of the present invention.

FIG. 8 is a diagram illustrating the reference current value output from the constant current circuit provided to the semiconductor device for driving a current load device according to the first embodiment of the present invention. With the constant current circuit 1 of the driving semiconductor device according to the present embodiment, the channel length L and the channel width W of the transistors Tr1 and Tr2 within the same circuit block are equal, and additionally, the ratio of the channel width W of the transistor in the V-I conversion circuit blocks I0 through I5 is WTr1_I0:WTr1_I1:WTr1_I2: WTr1_I3:WTr1_I4:WTr1_I5=WTr2_I0:WTr2_I1: WTr2_I2:WTr2_I3:WTr2__I4: WTr2_I5=1:2:4:8:16:32, and therefore, as illustrated in FIG. 8, thus can output six types of reference currents in which the ratio of output current i0 through i5 in the V-I conversion circuit blocks I0 through I5 is i0:i1:i2:i3:i4:i5=1:2:4:8:16:32.

Figure 4:
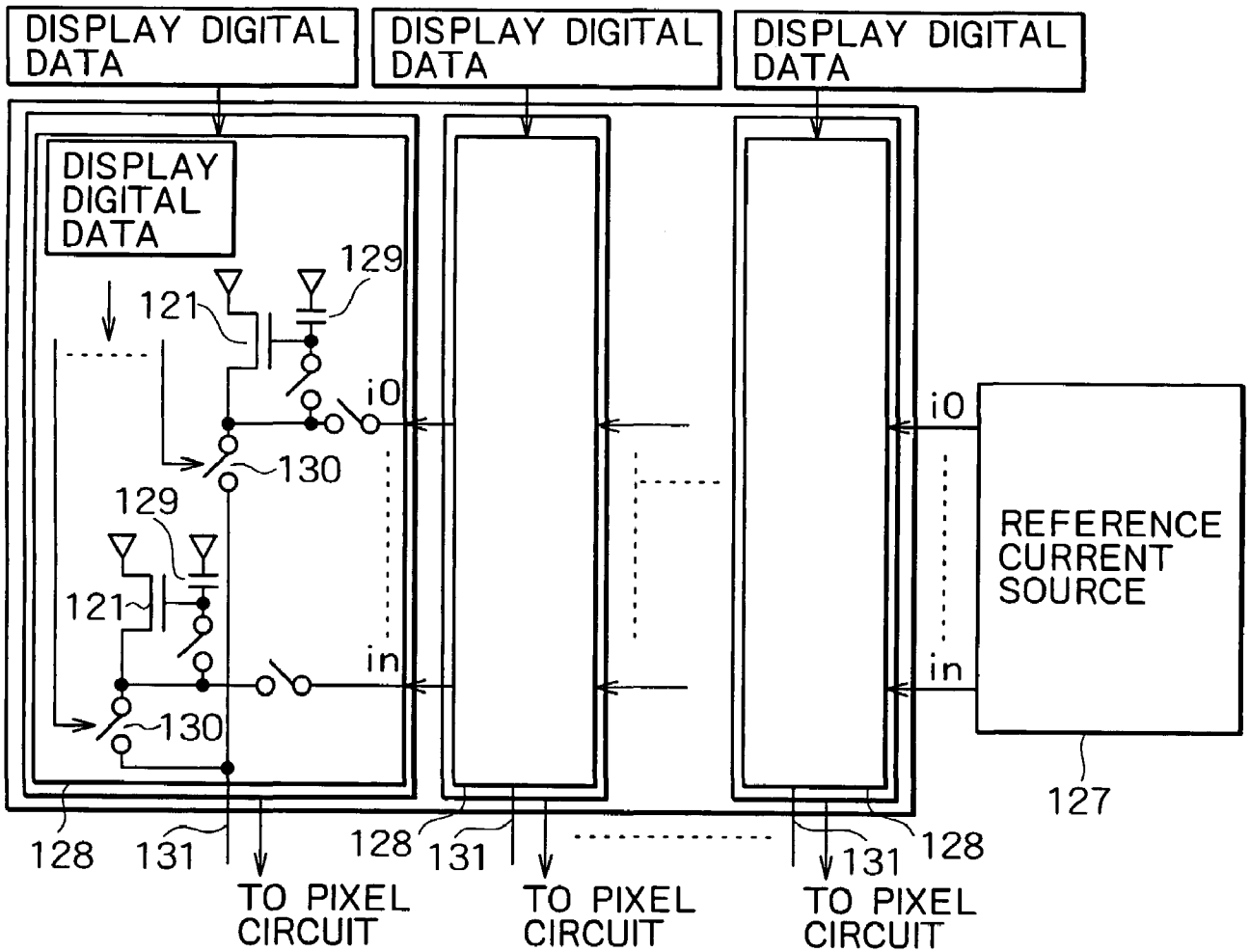
FIG. 4 (PRIOR ART)
FIG. 4 is a block diagram illustrating the operation of a drive circuit described in K. Abe et al., "16-1: A Poli-Si TFT 6-bit Current Data Driver for Active Matrix Organic Light Emitting Diode Displays", EURODISPLAY 2002 Proceeding, pp. 279-281.
Figure 5:
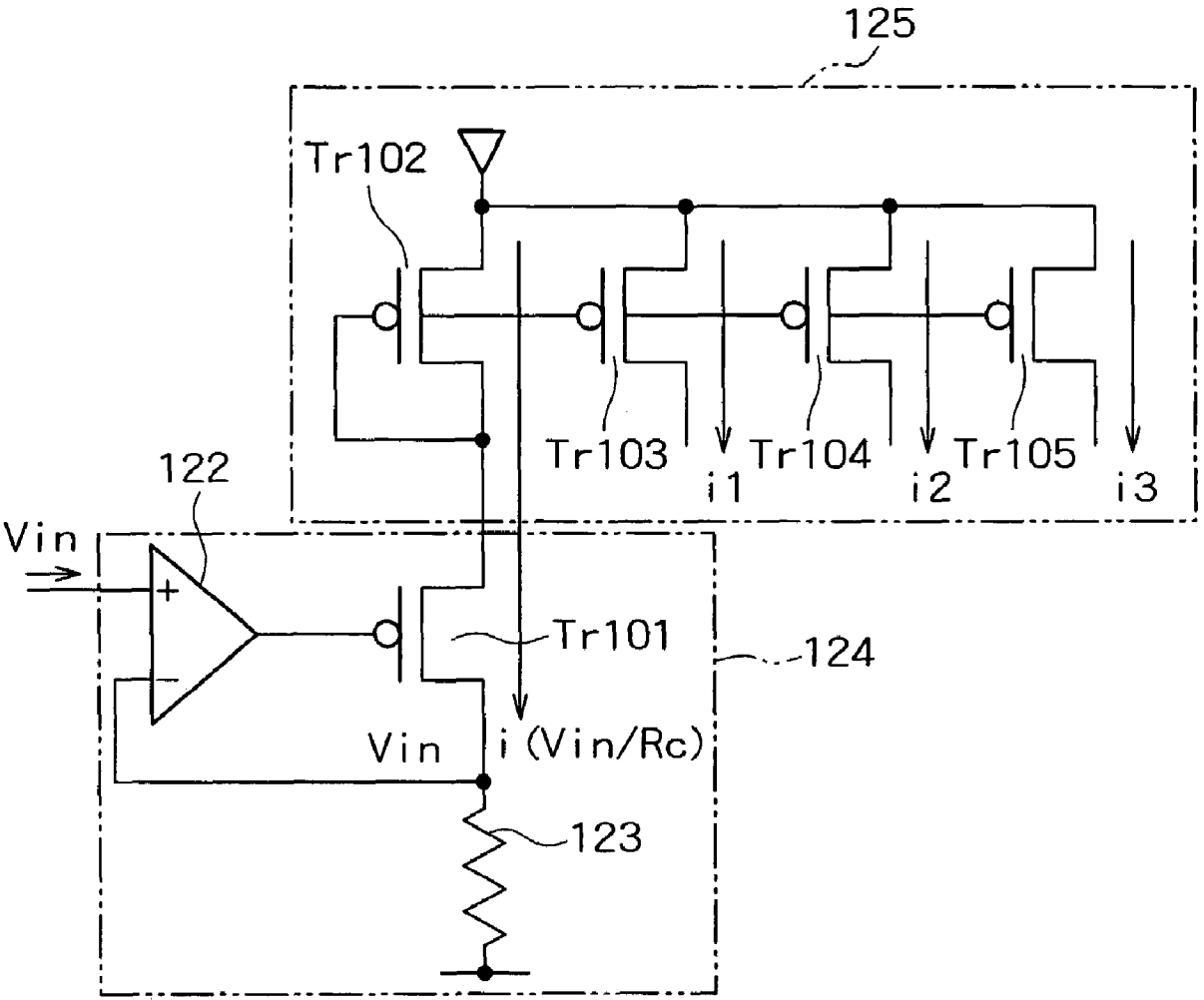
FIG. 5 (PRIOR ART)
FIG. 5 is a circuit diagram illustrating a constant current circuit described in Japanese Unexamined Patent Application Publication No. 2000-293245.
Figure 6:
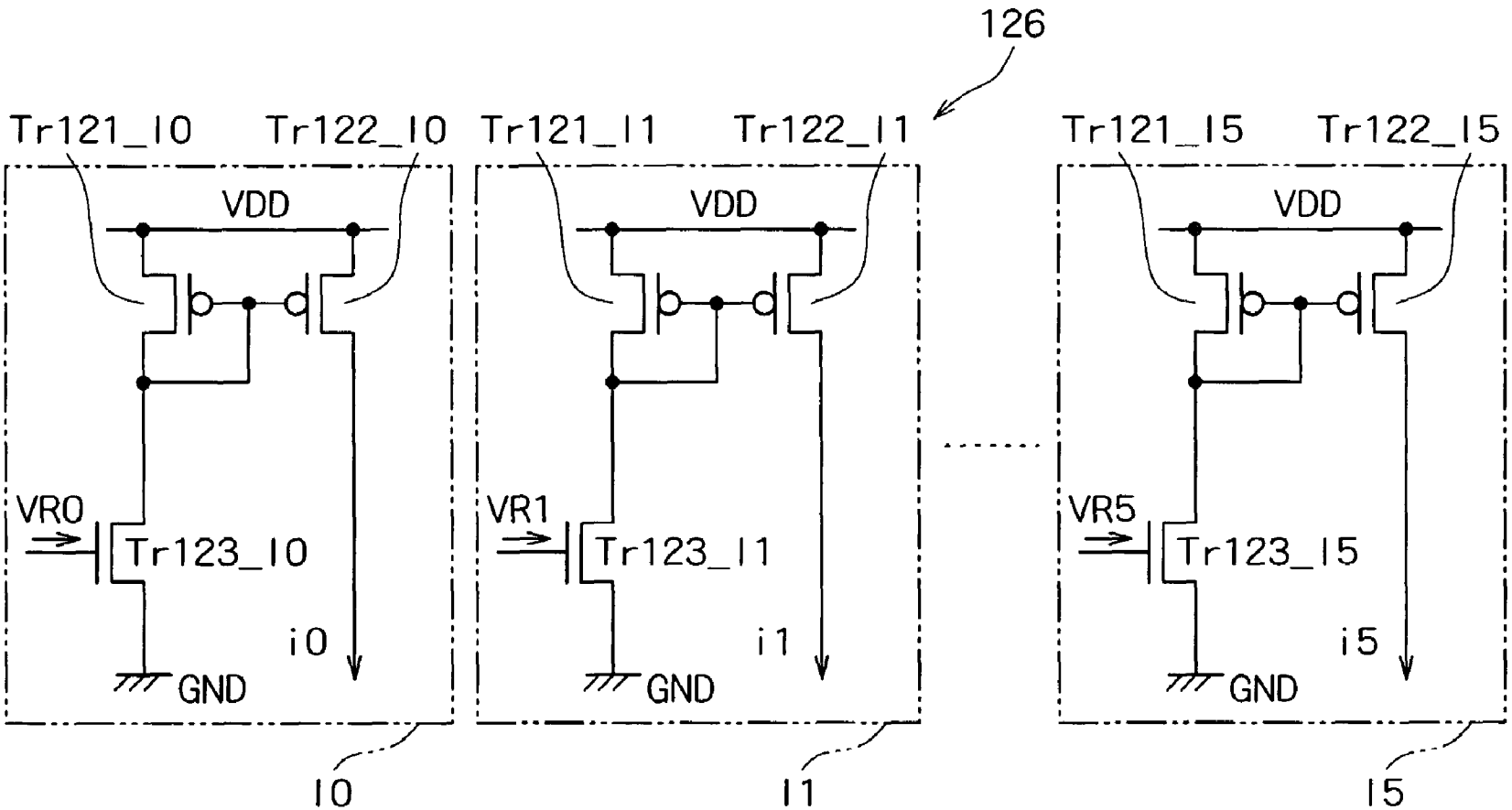
FIG.6 (PRIOR ART)
FIG. 6 is a circuit diagram illustrating a conventional constant current circuit.
Figure 9:
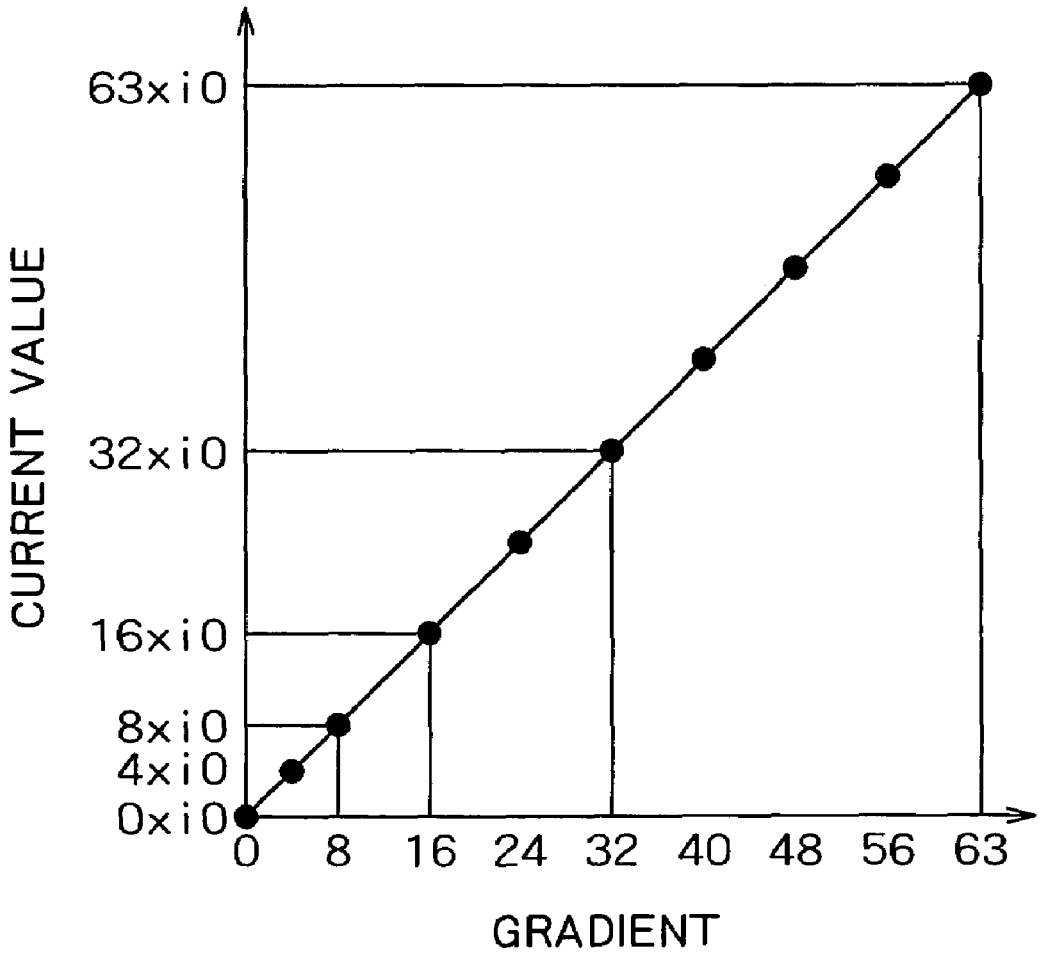
FIG. 9 is a graph illustrating the output current value of the semiconductor device for driving a current load device according to the first embodiment of the present invention, where the horizontal axis represents gradation and the vertical axis represents current value.

The drive circuit illustrated in FIG. 4 can be used as the drive circuit of the semiconductor device for driving a current load device according to the present embodiment. FIG. 9 is a graph illustrating the output current value of the semiconductor device for driving a current load device according to the first embodiment of the present invention, where gradation is on the horizontal axis and the current value is on the vertical axis. For example, by combining the constant current circuit 1 and the drive circuit which provided six current copier circuits that each supply the six output currents i0 through i5 that are output from this constant current circuit 1, and further by inputting 6-bit display digital data, a 64-level (from level 0 to level 63) current output illustrated in FIG. 9 can be realized. Further, by providing this semiconductor device for driving a current load device on an organic EL display device, an organic EL display device, which a 64-level display is capable, can be realized.

Next, the operation of the constant current circuit 1 provided to the semiconductor device for driving a current load device according to the present embodiment will be described. According to the present embodiment, a power source potential is applied to the power source electrode VDD, and while applying the negative power source potential to the ground electrode GND, a current control voltage Vc is input to the non-inversion input terminal of the operational amplifier 4. Thus, current i, which is determined by the resistance value r0 through r5 of the variable resistors Rv0 through Rv5 and the current control voltage Vc, flows to the V-I conversion unit 3. For example, in the case of the V-I conversion circuit block I0, voltage is output to the gate terminal of the transistor Tr3_I0 from the operational amplifier 4 so that the current i0 (=Vc/r0) flows to the transistor Tr3_I0. Thus, the current i0 (=Vc/r0) that flows to the transistor Tr3_I0 flows to the transistor Tr1_I0 of the current mirror circuit unit 2, and a voltage between the gate and the source of the transistor Tr1_I0 becomes the voltage that corresponds to the current i0. At this time, equal potential is applied to the transistor Tr2_I0 of which the gate terminal is connected to the gate terminal of the transistor Tr1_I0, a voltage between the gate and the source of the transistor Tr2_I0 becomes equal to the voltage between the gate and the source of the transistor Tr1_I0. With the constant current circuit 1, current i0 flows also to the transistor Tr2_I0 because the size of the transistor Tr1_I0 and the transistor Tr2_I0 are equal, and thus, the current i0 is output from the V-I conversion circuit block I0. The operation of the V-I conversion circuit blocks I1 through I5 within the constant current circuit 1 are the same as those of the above-described V-I conversion circuit.

Therefore, with the semiconductor device for driving a current load device according to the present embodiment, the resistance r0 through r5 of the variable resistors Rv0 through Rv5 in the V-I conversion circuit blocks I0 through I5 are preset to r0:r1:r2:r3:r4:r5=32:16:8:4:2:1, so that the ratio of output currents i0 through i5 in the V-I conversion circuit blocks I0 through I5 becomes i0:i1:i2:i3:i4:i5=(Vc/r0):(Vc/r1):(Vc/r2):(vc/r3):(Vc/r4):(Vc/r5)=1:2:4:8:16:32. Cases may exist at this time that the current ratio as designed cannot be obtained, due to the influence of the offset voltage of the operational amplifier 4, and due to the properties irregularities between the transistor Tr1 and the transistor Tr2 of the current mirror circuit unit 2. In that case, in the even that the semiconductor device for driving a current load device according to the present embodiment is provided to the organic EL display device, the output reference currents i0 through i5 can be the values as designed, by adjusting the resistance r0 through r5, while measuring the current flowing to the organic EL element or the brightness of the display screen.

Then, the six types of reference current i0 through i6 that are output from the constant current circuit 1 are each supplied to the current copier circuits of the drive circuit. Further, within the drive circuit, by combining the switch elements that are on state and off state, which are provided to the current copier circuits, the currents i0 through i6 that are output from the current copier circuits can be combined, and including the case that the current is 0, 64 types of current are output. Now, these currents are supplied to the pixel circuits via data lines.

With the semiconductor device for driving a current load device according to the present embodiment, since a common current control voltage Vc is input into all of the operational amplifiers 4 provided to the V-I conversion circuit blocks I0 through I5, after the resistance r0 through r5 of the variable resistors Rv0 through Rv5 are adjusted, and the ratio of the currents i0 through i5 that are output from the V-I conversion circuit blocks I0 through I5 is set to i0:i1:i2:i3:i4:i5=1:2:4:8:16:32, all of the currents can be increased/decreased easily while maintaining the ratio of the reference currents i0 through i5. Therefore, for example, in the case that the display unit of the organic EL display device is composed of RGB, by providing three constant current circuits 1 to correspond to each of R, G, and B, and by supplying reference currents i0 through i5 to the drive circuits corresponding to each of R, G, and B, from each of the constant current circuits 1, all of the currents can be increased/decreased without changing the ratio of the reference currents i0 through i5 for each color of RGB. As a result, adjusting the output current balance between the RGB, in other words, adjusting the white balance, can be easily performed.

Now, regarding the present embodiment, the case is described in which the output number of reference currents is six, and the current ratio is i0:i1: i2:i3:i4:i5=1:2:4:8:16:32, however, the present invention is not limited to this, and output numbers and current ratio can be set as appropriate, and effects equivalent to those of the present embodiment can be obtained even if the output number and the current ratio is changed.

Second Embodiment

Figure 10:
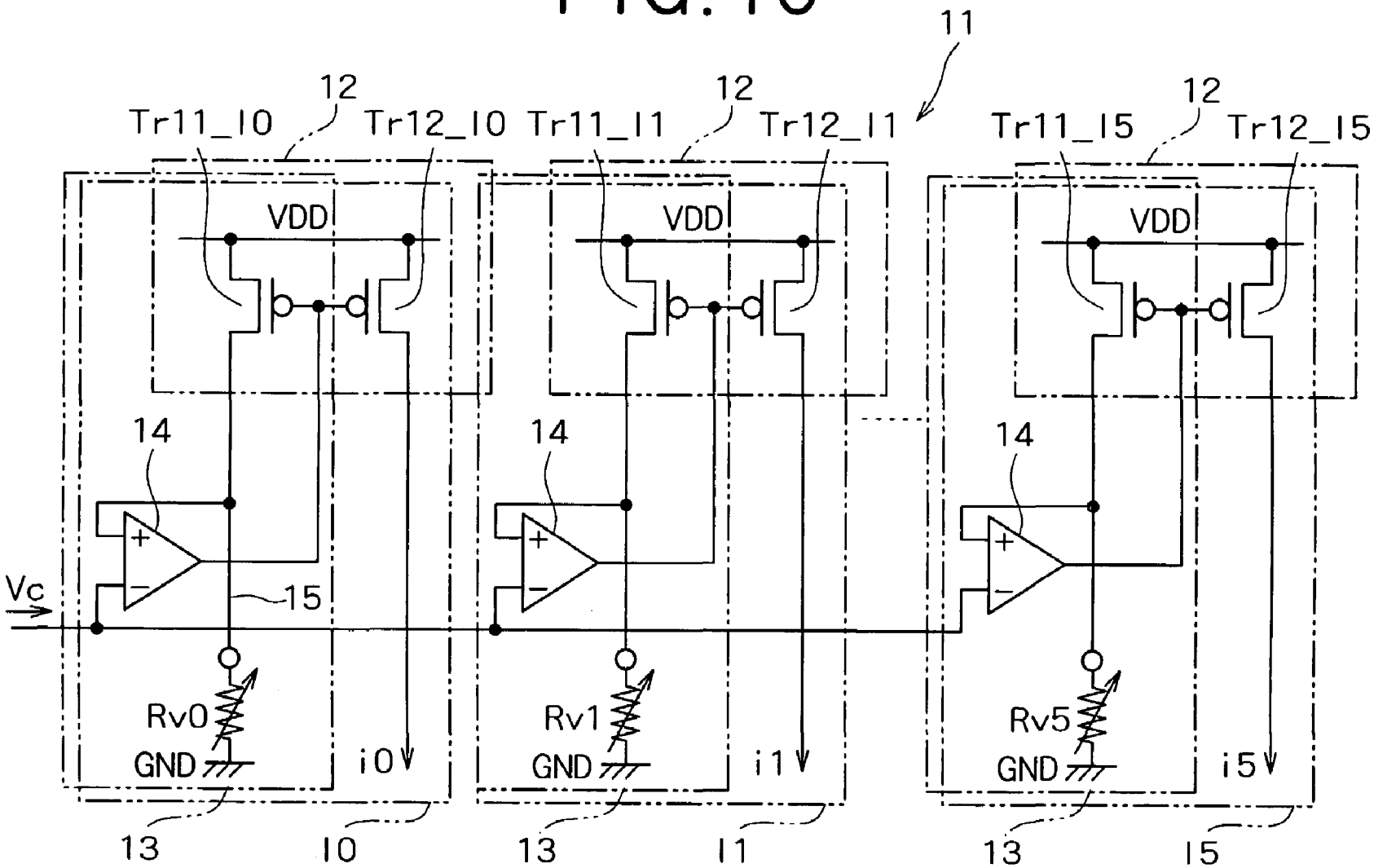
FIG. 10 is a circuit diagram illustrating the constant current circuit provided to the semiconductor device for driving a current load device according to a second embodiment of the present invention.

Next, a semiconductor device for driving a current load device relating to a second embodiment of the present invention will be described. The semiconductor device for driving a current load device according to the present embodiment comprises a drive circuit and a constant current circuit for outputting the reference current into this drive circuit, and like the first embodiment, is a semiconductor device that supplies current to the current drive elements such as organic EL elements. FIG. 10 is a circuit diagram illustrating the constant current circuit provided to the semiconductor device for driving a current load device according to the present embodiment. The above-described first embodiment has been described as a constant current circuit 1 having an N-type transistor Tr3, an operational amplifier 4, and variable resistors Rv0 through Rv5 that are capable of adjusting the resistance value, in the V-I conversion unit 3, but the constant current circuit 11 of the semiconductor device for driving a current load device according to the present embodiment does not provide an N-type transistor on the V-I conversion unit 13, and instead uses the P-type transistors Tr11 and Tr12 of the current mirror circuit unit 12. All other configurations and operations are the same as those of the above-described first embodiment. The constant current circuit 11 will be described below.

As illustrated in FIG. 10, the constant current circuit 11 provides a current mirror circuit unit 12 and a V-I conversion unit 13, and the six V-I conversion circuit blocks I0 through I5 that output the various differing currents are connected to'each other in parallel. With the V-I conversion block I0 of this constant current circuit 11, the source terminals of the P-type transistor Tr11_I0 and Tr12_I0 are connected to the power source electrode VDD, and the gate terminals of the transistor Tr11_I0 and Tr12_I0 are connected to each other as well as being connected to the output terminal of the operational amplifier 14. Further, the current control voltage Vc is input into the inversion input terminal of the operational amplifier 14, and the non-inversion input terminal is connected to the signal line 15 that the drain terminal of the transistor Tr11_I0 and the terminal on one side of the variable resistor Rv0 are connected. Further, the terminal on the other side of the variable resistor Rv0 is connected to a ground electrode GND. Then, the source terminal of the transistor Tr12_I0 becomes the output terminal of the constant current. With the V-I conversion current block I0, the current mirror circuit unit 12 comprises the transistor Tr11_I0 and the transistor Tr12_I0, and the V-I conversion unit 13 comprises the operational amplifier 14, the variable resistor Rv and the transistor Tr11_I0. The configuration and connections of the V-I conversion circuit blocks I0 through I5 of this constant current circuit 11 are the same as those of the above-described V-I conversion circuit block I0. Now, in the case that the semiconductor device for driving a current load device according to the present embodiment is provided to an organic EL display device, like the above-described first embodiment, the portion other than the variable resistors Rv is provided to a glass plate that forms the display unit, and the variable resistors Rv are provided to a portion other than the display unit.

Next, the size of the transistor provided to the constant current circuit 11 will be described. The P-type transistors Tr11 and Tr12 within the same V-I conversion circuit block have the same channel length L and channel width W, and therefore, the current ratio within the current mirror circuit unit 12 is 1. Further, in the case of different circuit blocks, the channel width W of the transistors Tr11 and Tr12 differ from one another, and with the channel width W of the transistor Tr11 as WTr11, and the channel width W of the transistor Tr12 as WTr12, the ratio thereof is WTr11_I0:WTr11_I1:WTr11_I2:WTr11_I3:WTr11_I4:WTr11_I5=WTr12_I0:WTr12_I1:WTr12_I2:WTr12_I3:WTr12_I4:WTr12_I5=1:2:4:8:16:32. Now, the channel length L of the transistors Tr11 and Tr12 are the same for all circuit blocks.

Next, the operation of the constant current circuit 11 will be described. According to the present embodiment, a power source potential is applied to the power source electrode VDD, and while applying the negative power source potential to the ground electrode GND, a current control voltage Vc is input to the non-inversion input terminal of the operational amplifier 14. Thus, current i, which is determined by the resistance value r0 through r5 of the variable resistors Rv0 through Rv5 and the current control voltage Vc, flows to the V-I conversion unit 13. For example, in the case of the V-I conversion circuit block I0, voltage is output from the operational amplifier 14 to the gate terminal of the transistor Tr11_I0 so that the current i0 (=Vc/r0) flows to the transistor Tr11_I0, and the current i0 (=Vc/r0) flows to the transistor Tr11_I0. Thus, like the above-described first embodiment, because a size and a voltage between the gate and the source of a transistor Tr12_I0 is equal to those of the transistor Tr1_I0 the current i0 flows also to the transistor Tr12_I0, thus the current i0 is output from the V-I conversion circuit block I0. The operations of the V-I conversion circuit blocks I1 through I5 within the constant current circuit 1 are the same as those of the above-described V-I conversion circuit block I0.

Therefore, with the semiconductor device for driving a current load device according to the present embodiment, the resistance r0 through r5 of the variable resistors Rv0 through Rv5 are preset to r0:r1:r2:r3:r4:r5=32:16:8:4:2:1, so that the ratio of output currents specified as i0 through i5 in the V-I conversion circuit blocks I0 through I5 becomes i0:i1:i2:i3:i4:i5=(Vc/r0):(Vc/r1):(vc/r2):(Vc/r3):(Vc/r4):(Vc/r5)=1:2:4:8:16:32. Cases may exist at this time that the current ratio as designed cannot be obtained, due to the influence of the offset voltage of the operational amplifier 14, or due to the properties irregularities between the transistor Tr11 and the transistor Tr12 of the current mirror circuit unit 12. In that case, in the event that the semiconductor device for driving a current load device according to the present embodiment is provided to the organic EL display device, the output current can be the values as designed, by adjusting the resistance r0 through r5, while measuring the current flowing to the organic EL element or the brightness of the display screen.

With the semiconductor device for driving a current load device according to the present embodiment, since a common current control voltage Vc is input into all of the operational amplifiers 14 provided to the V-I conversion circuit blocks I0 through I5, after the resistance r0 through r5 of the variable resistors Rv0 through Rv5 are adjusted, and the ratio of the currents i0 through i5 that are output from the V-I conversion circuit blocks I0 through I5 is set to i0:i1:i2:i3:i4:i5=1:2:4:8:16:32, all of the output currents can be increased/decreased easily while maintaining the ratio thereof. Therefore, for example, in the case that the display unit of the organic EL display device is composed of RGB, by providing three constant current circuits 11 to correspond to each of R, G, and B, and by supplying reference currents i0 through i5 to the drive circuits corresponding to the RGB from the constant current circuits 11, all of the currents can be increased/decreased without changing the ratio of the reference currents i0 through i5 for each color of RGB. As a result, adjusting the white balance can be easily performed. Further, the semiconductor device for driving a current load device according to the present embodiment does not require an N-type transistor, and therefore the circuits are simplified, and the circuit-forming region can be made smaller.

The semiconductor device for driving a current load device according to the above-described first and second embodiments is described in the case that a constant current circuit that outputs current using P-type transistors, however, the present invention is not limited to this, and for example, by changing the constant current circuit to the circuit configuration illustrated below, current can also be taken in.

In the case of taking in current, for example, with the constant current circuit 11 of the first embodiment, the transistor Tr1 and Tr2 are changed to N-type transistors, and the transistor Tr3 is changed to a P-type transistor. Then, the inversion input terminal and the non-inversion input terminal of the operational amplifier 4 are connected in reverse, and negative power source potential is applied to the power source electrode VDD, with the power source potential applied to the ground electrode GND. Further, with the constant current circuit 21 of the second embodiment, the transistor Tr11 and Tr12 are changed to N-type transistors, and the inversion input terminal and the non-inversion input terminal of the operational amplifier 14 are connected in reverse, and negative power source potential is applied to the power source electrode VDD, with the power source potential applied to the ground electrode GND.

Third Embodiment

Figure 11A:
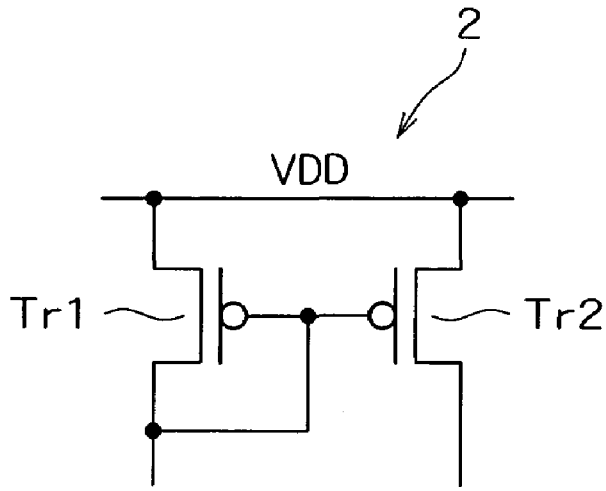
FIG. 11A is a circuit diagram illustrating the current mirror circuit unit of the constant current circuit provided to the semiconductor device for driving a current load device according to the first embodiment of the present invention.
Figure 11B:
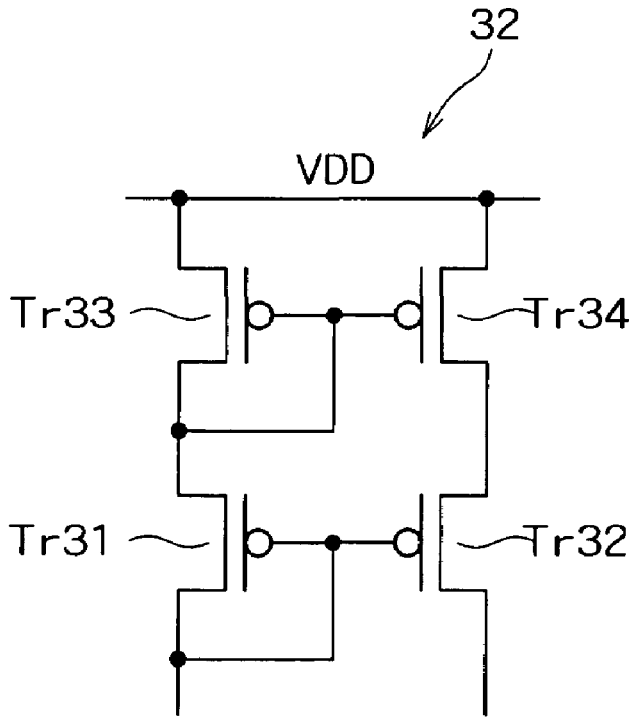
FIG. 11B is a circuit diagram illustrating the current mirror circuit unit of the constant current circuit provided to the semiconductor device for driving a current load device according to a third embodiment of the present invention.

Next, a semiconductor device for driving a current load device relating to a third embodiment of the present invention will be described. The semiconductor device for driving a current load device according to the present embodiment comprises a drive circuit and a constant current circuit for outputting the reference current into the drive circuit, and like the first and second embodiments, is a semiconductor device that supplies current to the current drive elements such as organic EL elements. FIG. 11A is a circuit diagram illustrating the current mirror circuit unit 2 of the constant current circuit provided to the semiconductor device for driving a current load device according to the first embodiment of the present invention, and FIG. 11B is a circuit diagram illustrating the current mirror circuit unit of the constant current circuit provided to the semiconductor device for driving a current load device according to the third embodiment of the present invention. The semiconductor device for driving a current load device according to the present embodiment uses a cascode-type current mirror circuit instead of a general current mirror circuit applied in the above described first embodiment. Except for the circuit configuration of this current mirror circuit unit, the configurations are the same as that of the above-described first embodiment. Only the current mirror circuit unit 32 of the constant current circuit will be described below.

As illustrated in FIG. 11A, with the current mirror circuit unit 2 of the constant current circuit of the first embodiment, the source terminals of the P-type transistor Tr1 and Tr2 are connected to the power source electrode VDD, and the gate terminals are connected to each other as well as to the drain terminal of the transistor Tr1. On the other hand, as illustrated in FIG. 11B, the current mirror circuit unit of the constant current circuit in the semiconductor device for driving a current load device of the present embodiment is a cascode-type current mirror circuit, and P-type transistors Tr33 and Tr34 are inserted between the source terminal of the P-type transistors Tr31 and Tr32, and the power source electrode VDD. In other words, the source terminals of the transistors Tr33 and Tr34 are connected to the power source electrode VDD, and the gate terminals of the transistors Tr33 and Tr34 are connected to each other as well as being connected to the drain terminal of the transistor Tr33. The drain terminal of the transistor Tr33 is connected to the source terminal of the transistor Tr31, and the drain terminal of the transistor Tr34 is connected to the source terminal of the transistor Tr32. Further, the gate terminal of the transistors Tr31 and Tr32 are connected to each other, as well as being connected to the drain terminal of the transistor Tr31.

Figure 12A:
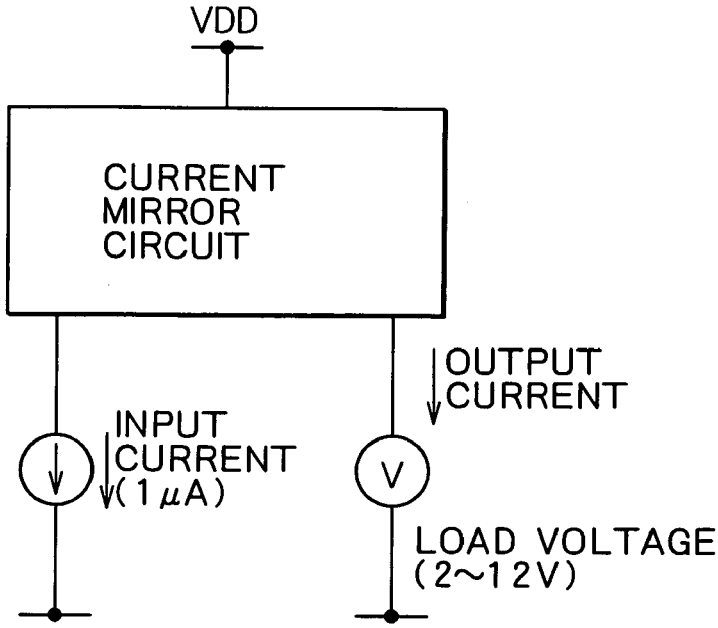
FIG. 12A is a diagram illustrating a simulation circuit with an output current property.
Figure 12B:
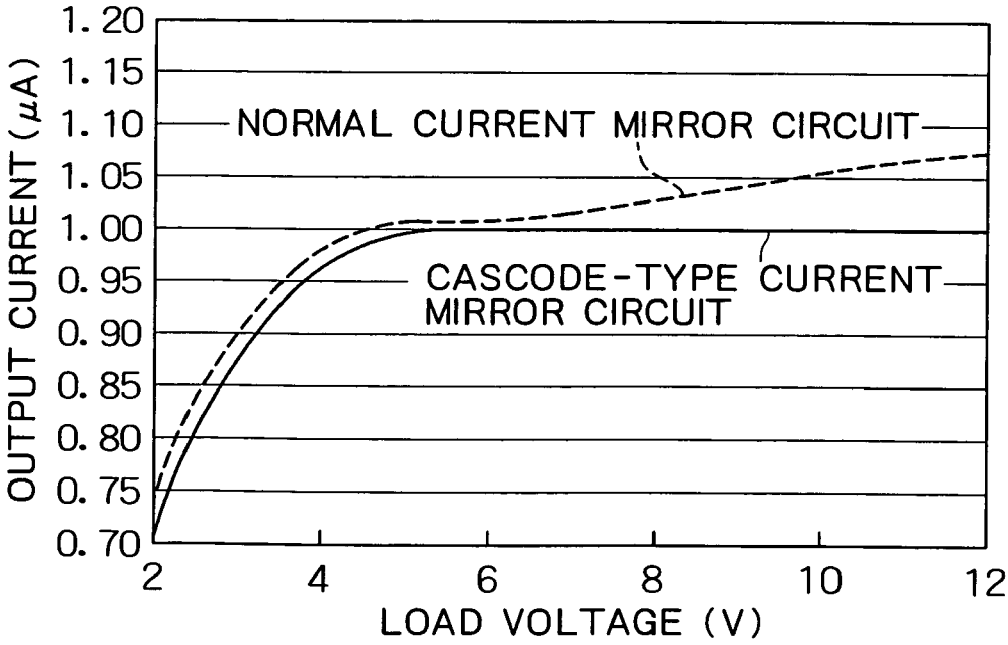
FIG. 12B is a graph illustrating the results of the simulation using the circuit illustrated in FIG. 12A, wherein the horizontal axis represents load voltage and the vertical axis represents output current.

With the semiconductor device for driving a current load device according to the present embodiment, by setting the configuration of the current mirror circuit unit 32 as that described above, in other words, as a cascode type current mirror circuit, a constant current can be output without being influenced by the variation of the power source or the variation of current load properties. FIG. 12A is a diagram illustrating a simulation circuit with an output current property, and FIG. 12B is a graph illustrating the results of the simulation using the circuit illustrated in FIG. 12A, wherein the load voltage is the horizontal axis and the output current is the vertical axis. The inventors of the present invention have performed circuit simulation of the current mirror circuit illustrated in FIGS. 11A and 11B, regarding the change in output current when the load voltage (the voltage at the current output terminal) varies between 2 and 12V when the current is 1 μA, using the simulation circuits illustrated in FIG. 12A, and discovered that the cascode type current mirror circuit (FIG. 11B) has a very small load voltage dependency compared to the current mirror circuit (FIG. 11A) applied in the constant current circuit of the above-described first embodiment. Therefore, by applying the cascode type current mirror circuit illustrated in FIG. 11B to the current mirror unit of the constant current circuit in the semiconductor device for driving a current load device of the above-described first and second embodiments, a constant current with a high degree of accuracy can be output without being influenced by the variation of the power source voltage or the variation of current load properties.

Fourth Embodiment

Next, a semiconductor device for driving a current load device relating to a fourth embodiment of the present invention will be described. The semiconductor device for driving a current load device according to the present embodiment comprises a drive circuit and a constant current circuit for outputting the reference current into the drive circuit, and like the first through third embodiments, is a semiconductor device that supplies current to the current drive elements such as organic EL elements. With the constant current circuit 11 provided to the semiconductor device for driving a current load device according to the second embodiment illustrated in FIG. 10, the output current i0 through i5 may shift by an amount equivalent to the offset voltage Voff, in the case that the operational amplifier 14 of the V-I conversion unit 13 has an offset voltage Voff. Further, this offset voltage Voff is generated from the irregularities of the properties of the transistor that is the input terminal of the operational amplifier 14, and generally, the offset voltage Voff differs according to the applied potential. For example, in the case that the offset voltage of the non-inversion input terminal is Voff higher than the offset voltage of the inversion terminal, the output current i0=((Vc+Voff)/ro) in the V-I conversion circuit block I0, and the output current shifts from the ideal value by an amount equivalent to Voff.

Figures 13A, 13B:
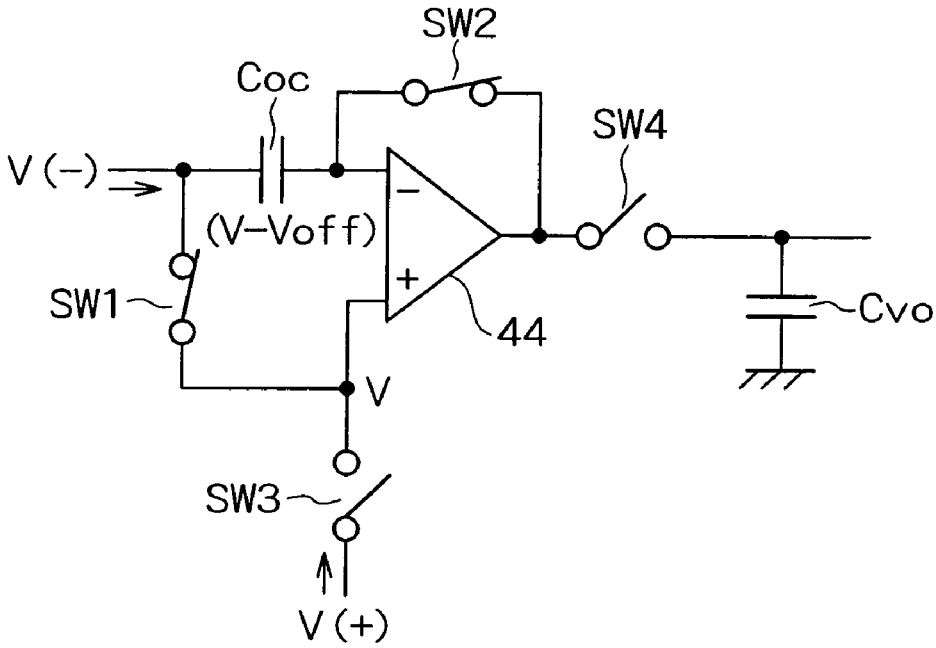
FIG. 13A is a circuit diagram illustrating the operational amplifier of the V-I conversion unit of the constant current circuit provided to the semiconductor device for driving a current load device according to a fourth embodiment of the present invention.
FIG. 13B is a timing diagram thereof.

Therefore, with semiconductor device for driving a current load device according to the present embodiment, an offset cancel function is attached to the operational amplifier of the V-I conversion unit, in order to correct the current of this offset voltage amount. FIG. 13A is a circuit diagram illustrating the operational amplifier of the V-I conversion unit of the constant current circuit provided to the semiconductor device for driving a current load device according to the present embodiment of the present invention, and FIG. 13B is a timing diagram thereof. As illustrated in FIG. 13A, four switch devices SW1 through SW4, a capacitor Coc that stores the offset voltage and a capacitor Cvo that stores the output voltage are provided to the operational amplifier 44 of the V-I conversion unit. The inversion input terminal of the operational amplifier 44 is connected to the capacitor Coc, and the voltage V (−) is input via the capacitor Coc. On the other hand, the non-inversion input terminal of the operational amplifier 44 is connected to the switch device SW3. The switch SW3 is connected to the source terminal of the P-type transistor (not shown) of the current mirror unit, and the voltage V (+) is input into the operational amplifier 44 via the switch SW3. Further, the output terminal of the operational amplifier 44 is connected to the gate terminal of the P-type transistor of the current mirror unit via the switch SW4, and the voltage output from the output terminal of the operational amplifier 44 is output via the switch device SW4. Also, a switch device SW1 is connected between the non-inversion input terminal and the external power source, and a switch device SW2 is connected between the inversion input terminal and the output terminal, and the capacitor Cvo is connected between the switch device SW4 and the gate terminal of the P-type transistor of the current mirror unit. Now, the semiconductor device for driving a current load device according to the present embodiment the same as that of the above-described second embodiment, except for the constant current circuit V-I conversion unit.

Next, the operation of the circuit illustrated in this FIG. 13A will be described. This circuit has the two operating states of the offset cancel period necessary for canceling the offset voltage and the normal operational amplifier operation period. The offset cancel period is the state wherein the switch devices SW1 and Sw2 are on and the switch devices SW3 and SW4 are off, and thus, the voltage on both terminals of the capacitor Coc become equal to the offset voltage Voff. Since the capacitor Cvo stores the output voltage even if the switch SW4 is off state, continues to be applied potential to the external circuit, even in the offset cancel period that the switch SW4 becomes off state. On the other hand, by the switches SW3 and SW4 becomes on state, the offset voltage Voff is held in the voltage within both terminals of the capacitor Coc. As a result, since the potential applied to the inversion input terminal is constantly lower than the input voltage V (−) by the offset voltage Voff, the operational amplifier 44 can operate in the offset cancel state. In other words, the constant current circuit, which the V-I conversion unit of such circuit configuration is provided, is not influenced by the offset voltage, and therefore can constantly output the output current i that is determined by the current control voltage Vc and the resistance value Rv. Now, the offset cancel period and the normal operational amplifier operation period can simply be repeated, for example, in the case of an organic EL display device, according to the rewrite cycle (frame cycle) of the display screen.

Further, with the semiconductor device for driving a current load device according to the present embodiment, since an offset cancel function is added to the operational amplifier 44 and thus influence is not received from the offset voltage, after the resistance r0 through r5 of the variable resistors Rv0 through Rv5 are adjusted, and the ratio of the currents i0 through i5 that are output from the V-I conversion circuit blocks I0 through I5 is set to i0:i1:i2:i3:i4:i5=1:2:4:8:16:32, all of the currents can be increased/decreased while maintaining the ratio thereof, with a higher degree of accuracy than the semiconductor device for driving a current load device according to the above-described first or second embodiments. Therefore, for example, in the case that the display unit of the organic EL display device is composed of RGB, by providing three constant current circuits to correspond to RGB, and by supplying reference currents i0 through i5 to the drive circuits corresponding to the RGB from the constant current circuits, all of the currents can be increased/decreased without changing the ratio of the reference currents i0 through i5 for each color of RGB. As a result, adjusting the white balance can be performed easily and with greater accuracy.

Fifth Embodiment

Figures 14A, 14B:
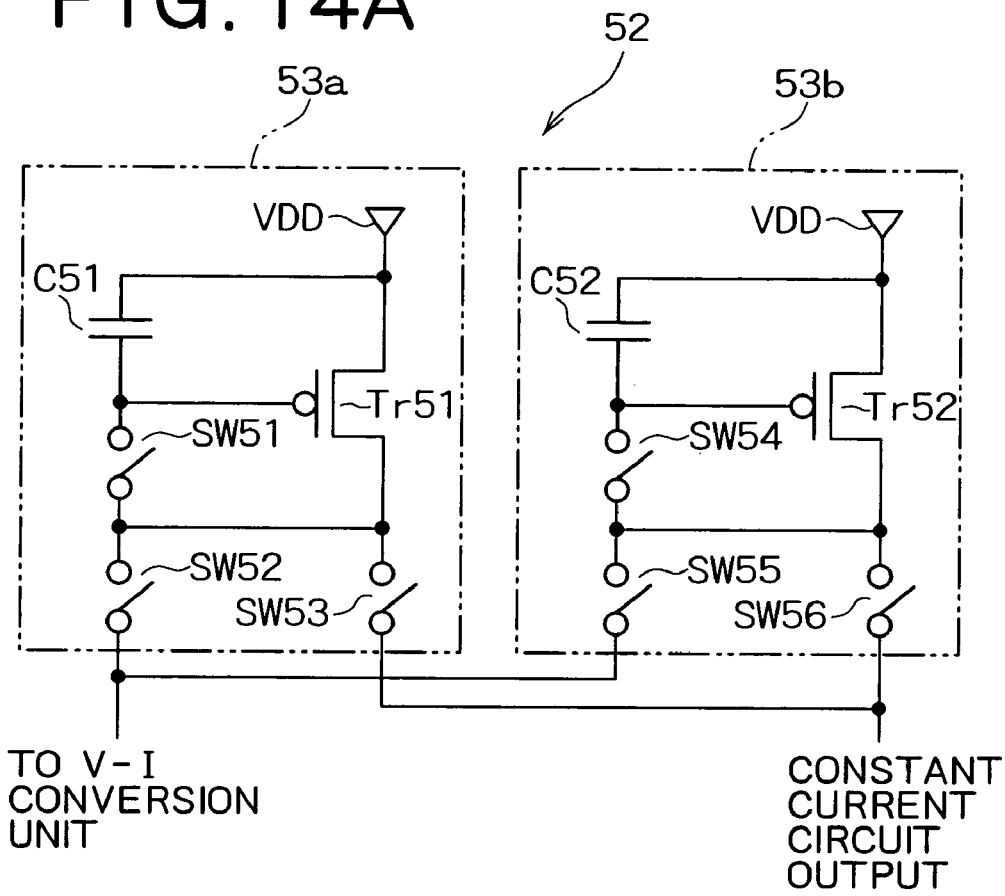
FIG. 14A is a circuit diagram illustrating the current copier circuit unit of the constant current circuit provided to the semiconductor device for driving a current load device according to a fifth embodiment of the present invention.
FIG. 14B is a timing diagram thereof.

Next, the semiconductor device for driving a current load device according to a fifth embodiment comprises a drive circuit and a constant current circuit for outputting the reference current into this drive circuit, and like the first through fourth embodiments, is a semiconductor device that supplies current to the current drive elements such as organic EL elements. FIG. 14A is a circuit diagram illustrating the current copier circuit unit of the constant current circuit provided to the semiconductor device for driving a current load device according to the fifth embodiment of the present invention, and FIG. 14B is a timing diagram thereof. The constant current circuit of the present embodiment is provided a current copier circuit unit 52 instead of a current mirror circuit unit, and otherwise is the same as the above-described the semiconductor device for driving a current load device according to the first embodiment. This current copier circuit unit 52 will be described below. As illustrated in FIG. 14A, the current copier circuit unit 52 is configured with circuits 53*a* and 53*b* which the circuit configuration is the same. The circuit 53*a* is provided with a drive transistor Tr51 that performs output operation and current storing, a capacitor C51 that stores the voltage between the gate and the source of the drive transistor Tr51, and three switch devices SW51 through SW53, and the circuit 53*b* is provided with a drive transistor Tr52 that performs output operation and current storing, a capacitor C52 that stores the voltage between the gate and the source of the drive transistor Tr52, and three switch devices SW54 through SW56.

With the circuit 53*a*, the source terminal of the drive transistor Tr51 is connected to the power source electrode VDD, and the drain terminal is connected to the switch device SW53. Further, one terminal of the capacitor C51 is connected between the source terminal of the drive transistor Tr51 and the power source electrode VDD, and the other terminal of this capacitor C51 is connected to the gate terminal of the transistor Tr51 as well as the switch device SW51 and the switch device SW52 are connected in this order. On the other hand, with the circuit 53*b*, the source terminal of the drive transistor Tr52 is connected to the power source electrode VDD, and the drain terminal is connected to the switch device SW56. Further, one terminal of the capacitor C52 is connected between the source terminal of the drive transistor Tr52 and the power source electrode VDD, and the other terminal of this capacitor C52 is connected to the gate terminal of the transistor Tr52 as well as the switch device SW54 and the switch device SW55 are connected in this order. Also, the switch devices SW52 and SW55 are connected to the V-I conversion unit, and the switch devices SW53 and SW56 are connected to the constant current output terminal.

Next, the operation of this current copier circuit unit 52 will be described. As illustrated in FIG. 14B, the current copier circuit unit 52 has the two operating modes of storing and output, and therefore, when the circuit 53*a* is executing the operation to store the current, the circuit 53*b* performs the operation to output the current, and when the circuit 53*a* is executing the operation to output the current, the circuit 53*b* performs the operation to store the current. During the time the circuit 53*a* is executing current storing, the switches SW51 and SW52 become on state and the SW53 becomes off state, and the current specified by the V-I conversion unit (not shown) flows to the drive transistor Tr51, and a voltage between the gate and the source corresponding to that current generates to the capacitor C51. On the other hand, during the time the circuit 53*a* is executing current output, the switches SW51 and SW52 become off state and the SW53 becomes on state, and the current that corresponds to the voltage between the gate and the source stored in the capacitor C51, in other words, the current specified in the V-I conversion unit, is output externally from the output terminal. The current operations of current storing operation time and current output operation time are the same as those of the above-described circuit 53*a*. Thus, current can be output with a higher degree of accuracy, without being influenced by the transistor irregularities.

Sixth Embodiment

Figure 1:
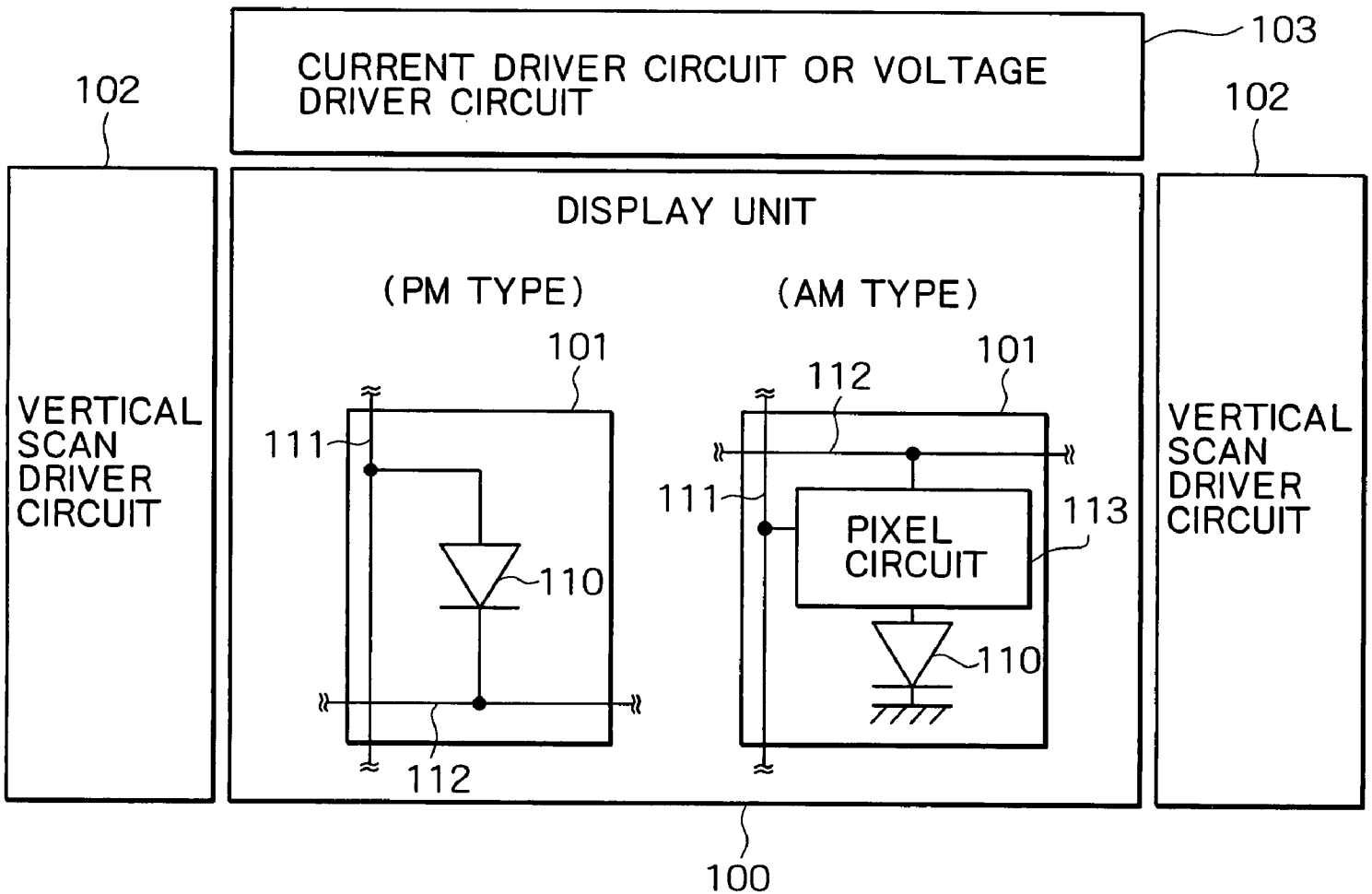
FIG. 1 (PRIOR ART)
FIG. 1 is a block diagram illustrating the configuration of an organic EL display device.
Figure 2:
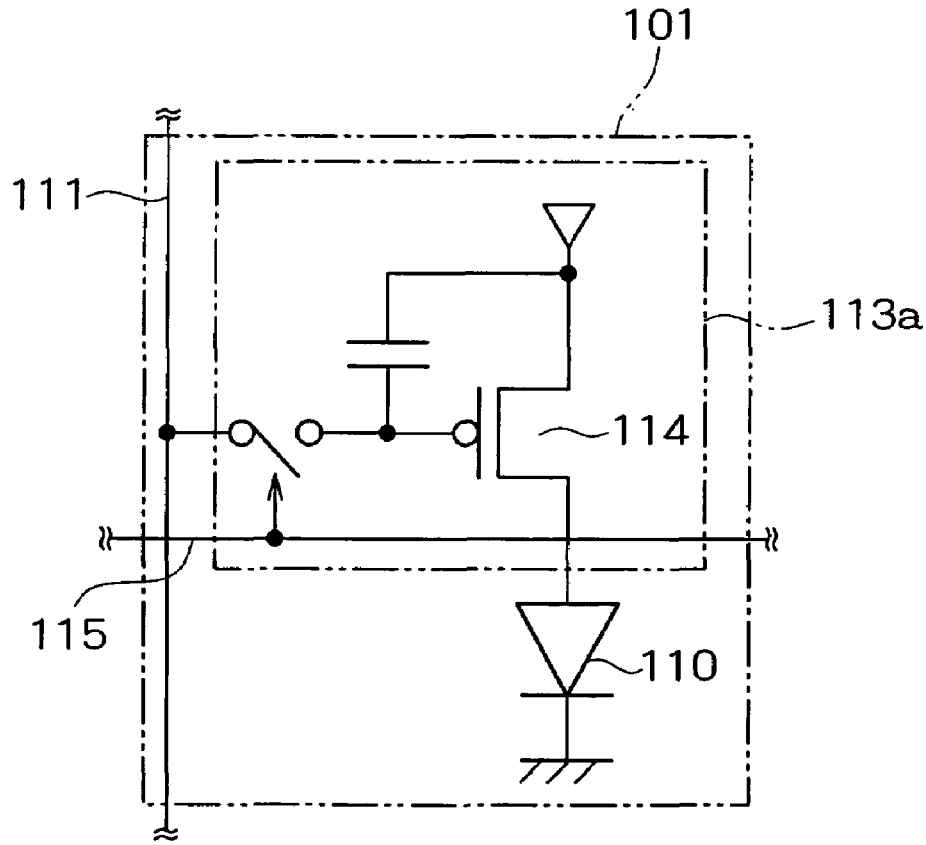
FIG. 2 (PRIOR ART)
FIG. 2 is a circuit diagram illustrating a voltage-write and current-drive pixel circuit.
Figure 3:
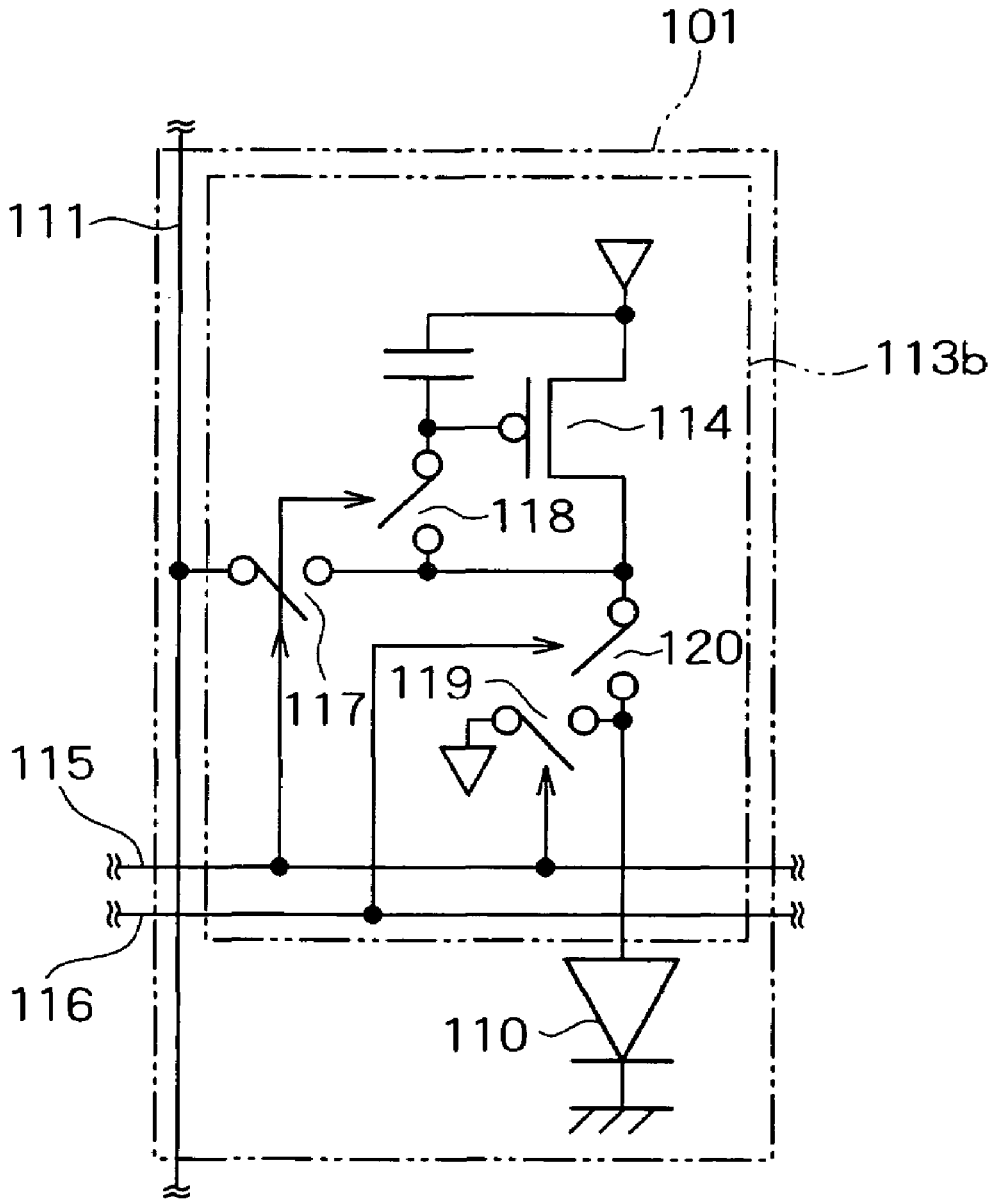
FIG. 3 (PRIOR ART)
FIG. 3 is a circuit diagram illustrating a current-write and current-drive type pixel circuit.
Figure 15:
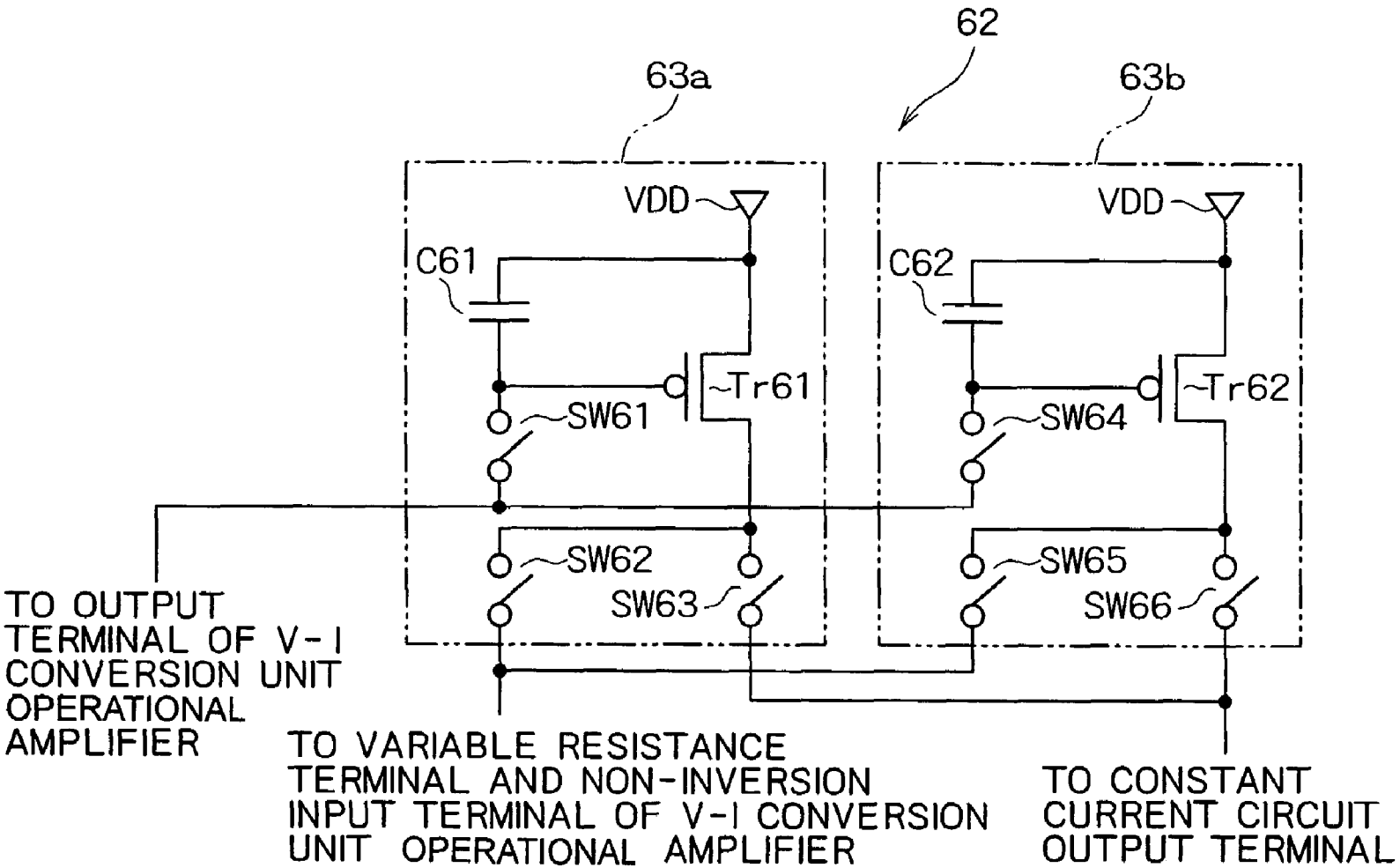
FIG. 15 is a circuit diagram illustrating the current copier circuit unit of the constant current circuit provided to the semiconductor device for driving a current load device according to a sixth embodiment of the present invention.

Next, the semiconductor device for driving a current load device according to a sixth embodiment comprises a drive circuit and a constant current circuit for outputting the reference current into this drive circuit, and like the first through fifth embodiments, is a semiconductor device that supplies current to the current drive elements such as organic EL elements. FIG. 15 is a circuit diagram illustrating the current copier circuit unit of the constant current circuit provided to the semiconductor device for driving a current load device according to the sixth embodiment of the present invention. For example, in the case that a current copiers circuit unit is provided instead of a current mirror circuit unit 12 of the constant current circuit 11 on the semiconductor device for driving a current load device according to the second embodiment illustrated in FIG. 2, the current copier circuit unit is included in the V-I conversion unit 13, and therefore the circuit configuration illustrated in FIG. 14A is not applicable. Therefore, with the semiconductor device for driving a current load device according to the present embodiment, the current copier circuit unit 62 is configured with circuit 63*a* and circuit 63*b*, which the circuit configuration is the same as that illustrated in FIG. 15.

In other words, the current copier circuit unit 62 is connected to the output terminal of the operational amplifier provided to the V-I conversion unit, after the gate terminals of the drive transistors Tr61 and Tr62 are connected to each other via the switch devices SW61 and SW64. Further, the drain terminal of the drive transistors Tr61 and Tr62 are connected to the terminals of the variable resistors Rv and the non-inversion input terminals of the operational amplifier of the V-I conversion unit, after they are connected to each other via the switches devices SW62 and SW65, and are also connected to the output terminal after they are connected to each other via the switches devices SW63 and SW66. Further, between the power source electrode VDD and the source terminals of the drive transistors Tr61 and Tr62, one terminal of the capacitor C61 and C62 are each connected, and the other terminal of these capacitors C61 and C62 are connected to the switch devices SW61 and SW64.

The connected state of the current copier circuit unit 62 illustrated in FIG. 15 and the current copier circuit unit 52 illustrated in FIG. 14A differ, but the switching of operations of the circuit 63*a* and circuit 63*b* and the state of on or off of the switch devices in each operating mode is the same. Now, the cycle for switching from current storing to current output can be set to match the rewrite cycle of the display screen (frame cycle) in the case that, for example, the current copier and so forth of the above-described fifth embodiment and the present embodiment are provided to the organic EL display device. Thus, current can be output with a higher degree of accuracy, without being influenced by the transistor irregularities.

With the semiconductor device for driving a current load device of the first and second embodiments that a current mirror circuit unit is provided to the constant current circuit, the output current ratio may not be as specified if the properties of the pair of drive transistors that constitutes of the current mirror circuit unit have irregularities; however, with the semiconductor device for driving a current load device of the fifth and sixth embodiments that a current copier circuit unit is provided to the constant current circuit, the drive transistor within the current copier circuit stores the specified current with the V-I conversion unit and also outputs current equal to this stored current value, and therefore is not influenced by any transistor property irregularities.

Further, by providing a V-I conversion unit wherein an offset cancel function as illustrated in FIG. 13A is attached to a provided operational amplifier, a current copier circuit unit illustrated in FIG. 14A or FIG. 15, and resistors with absolute accuracy, current can be output with a high degree of accuracy in addition to the variable resistors being unnecessary, in other words, adjustment is unnecessary. Further, in the case that resistors are provided that have poor absolute accuracy but good relative accuracy, the output current as designed can be obtained, simply by adjusting the current control voltage Vc.

Seventh Embodiment

Figures 16A, 16B:
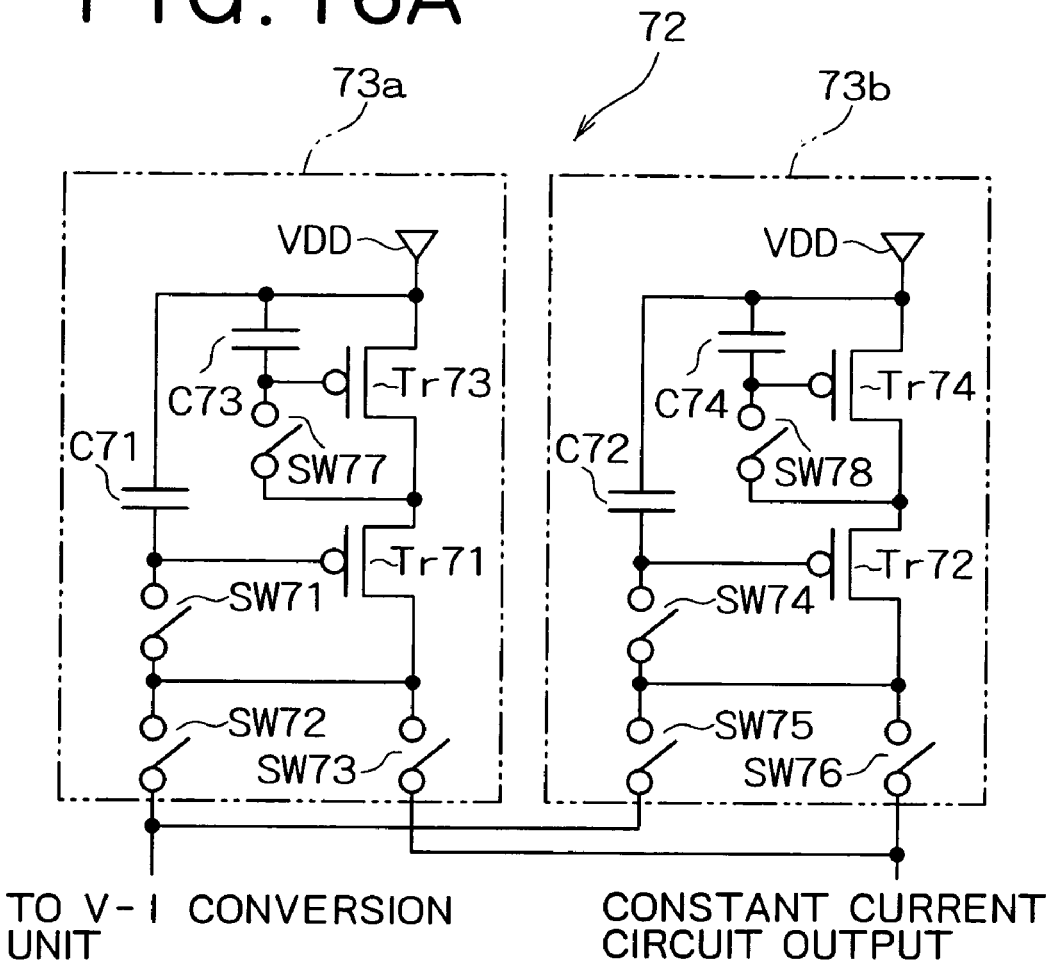
FIG. 16A is a circuit diagram illustrating the current copier circuit unit of the constant current circuit provided to the semiconductor device for driving a current load device according to a seventh embodiment of the present invention.
FIG. 16B is a timing diagram thereof.

Next the semiconductor device for driving a current load device according to a seventh embodiment comprises a drive circuit and a constant current circuit for supplying the reference current into this drive circuit, and like the first through sixth embodiments, is a semiconductor device that supplies current to the current drive elements such as organic EL elements. FIG. 16A is a circuit diagram illustrating the current copier circuit unit of the constant current circuit provided to the semiconductor device for driving a current load device according to the present embodiment, and FIG. 16B is a timing diagram thereof. As described in the above-described third embodiment, by changing the current copier circuit unit in the constant current circuit to a cascode type, a constant current output can be obtained without being influenced by variations of the power source voltage or variations of the current load. Therefore, the semiconductor device for driving a current load device according to the present embodiment provides a cascode-type current copier circuit unit 72 instead of the current copier circuit unit 52 illustrated in FIG. 14A, and otherwise is the same as the above-described the semiconductor device for driving a current load device according to the fifth embodiment.

As illustrated in FIG. 16A, the current copier circuit unit 72 of the constant current circuit provided to the semiconductor device for driving a current load device according to the present embodiment is a cascode-type current copier circuit, and within circuit 73*a*, a drive transistor Tr73 is connected between the source terminal of the drive transistor Tr71 and the power source electrode VDD, and one terminal of the capacitor C73 is connected between the capacitor C71 and the power source electrode VDD, and the other terminal of this capacitor C73 is connected to the gate terminal of the transistor Tr73 as well as being connected between the source terminal of the transistor Tr71 via the switch device SW77 and the drain terminal of the transistor Tr73. On the other hand, within circuit 73*b*, a drive transistor Tr74 is connected between the source terminal of the drive transistor Tr72 and the power source electrode VDD, and one terminal of the capacitor C74 is connected between the capacitor C72 and the power source electrode VDD, and the other terminal of this capacitor C74 is connected to the gate terminal of the transistor Tr74 as well as being connected between the source terminal of the transistor Tr72 via the switch device SW78 and the drain terminal of the transistor Tr74. This current copier circuit unit 72 is the same as the current copier circuit unit 52 illustrated in FIG. 16A, except that drive transistors Tr73 and Tr74, capacitors C73 and C74, and switch devices SW77 and SW78 have been added.

Like the current copier circuit unit 52 according to the above-described fifth embodiment, with this current copier circuit unit 72, when the circuit 73*a* is executing the operation to store the current the circuit 73*b* performs the operation to output the current, and when the circuit 73*a* is executing the operation to output the current, the circuit 73*b* performs the operation to store the current. Then, as illustrated in FIG. 16B, during the time the circuit 73*a* is executing the current storing, the switches SW71, Sw72, and SW77 become on state and the SW73 becomes off state, and the current specified by the V-I conversion unit flows to the drive transistor Tr71 and the drive transistor Tr73, and a voltage between the gate and the source corresponding to that current generates to the capacitors C71 and C73. On the other hand, during the time the circuit 73*a* is executing current output, the switches SW71, SW72, and SW77 become off state and the SW73 becomes on state, and the current that is stored in the drive transistor Tr71 and the drive transistor Tr73, in other words, the current generated in the V-I conversion unit, is output externally from the output terminal. Thus, with the cascode-type current copier circuit unit 72, since the drive transistors Tr71 and Tr73 are connected by cascode connection in the circuit 73*a*, and since the drive transistors Tr72 and Tr74 are connected by cascode connection in the circuit 73*a*, the variation dependency of the power source voltage and the current load is extremely small, and current can be output with a higher degree of accuracy.

Eighth Embodiment

Figure 17:
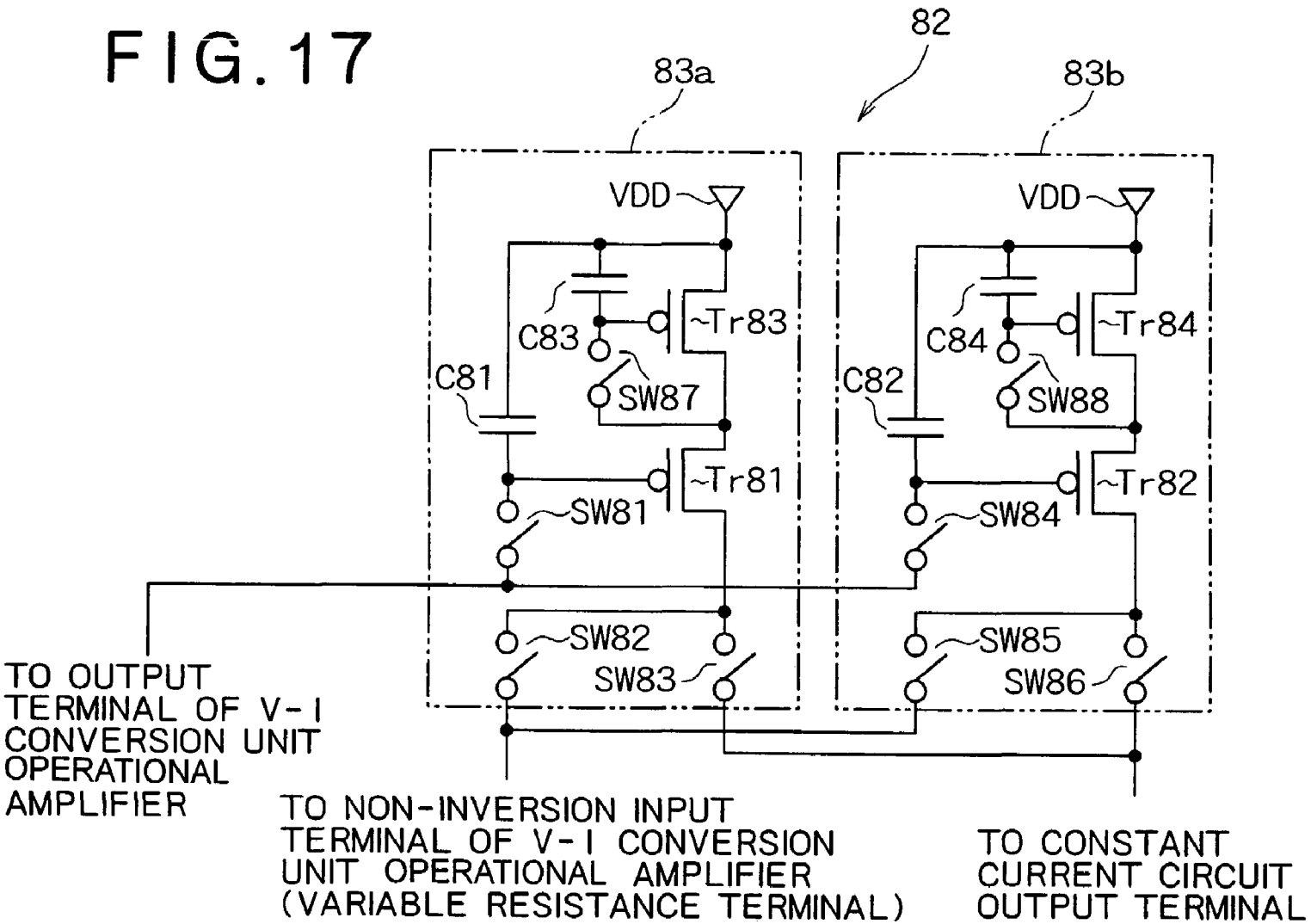
FIG. 17 is a circuit diagram illustrating the current copier circuit unit of the constant current circuit provided to the semiconductor device for driving a current load device according to the eighth embodiment of the present invention.

Next, the semiconductor device for driving a current load device according to an eighth embodiment comprises a drive circuit and a constant current circuit for supplying the reference current into this drive circuit, and like the first through seventh embodiments, is a semiconductor device that supplies current to the current drive elements such as organic EL elements. FIG. 17 is a circuit diagram illustrating the current copier circuit unit of the constant current circuit provided to the semiconductor device for driving a current load device according to the present embodiment of the present invention. The semiconductor device for driving a current load device according to the present embodiment provides a cascode-type current copier circuit unit 82 instead of the current copier circuit unit 62 illustrated in FIG. 16, and otherwise is the same as the above-described the semiconductor device for driving a current load device according to the sixth embodiment.

As illustrated in FIG. 17, the current copier circuit unit 82 of the constant current circuit provided to the semiconductor device for driving a current load device according to the present embodiment is a cascode-type current copier circuit, and within circuit 83*a*, a drive transistor Tr83 is connected between the source terminal of the drive transistor Tr81 and the power source electrode VDD, and one terminal of the capacitor C83 is connected between the capacitor C81 and the power source electrode VDD, and the other terminal of this capacitor C83 is connected to the gate terminal of the transistor Tr83 as well as being connected between the source terminal of the transistor Tr81 and the drain terminal of the transistor Tr83 via the switch device SW87. On the other hand, within circuit 83*b*, a drive transistor Tr84 is connected between the source terminal of the drive transistor Tr82 and the power source electrode VDD, and one terminal of the capacitor C84 is connected between the capacitor C82 and the power source electrode VDD, and the other terminal of this capacitor C84 is connected to the gate terminal of the transistor Tr84 as well as being connected between the source terminal of the transistor Tr82 and the drain terminal of the transistor Tr84 via the switch device SW88. This is the same as the current copier circuit unit 62 illustrated in FIG. 15, except that drive transistors Tr83 and Tr84, capacitors C83 and C84, and switch devices SW87 and SW88 have been added.

The connected state of this cascode-type current copier circuit unit 82 and the current copier circuit unit 72 illustrated in FIG. 16A differ, but the switching of operations of the circuit 83*a* and circuit 83*b* and the state of on or off of the switch devices in each operating mode is the same. Therefore, even with the semiconductor device for driving a current load device according to the present embodiment, the dependency to the variation of power source voltage and the current load variation is extremely small, and current can be output with a higher degree of accuracy.

Now, regarding the semiconductor device for driving a current load device according to the above-described first through eighth embodiments, a case has been described that the drive circuit illustrated in FIG. 4 is combined therewith, but the present invention is not limited to this, and can be combined with other drive circuits, and the drive circuit to be combined can by any circuit that supplies current corresponding to the reference current that is output by the constant current circuit to a current load device.

Further, regarding the semiconductor device for driving a current load device according to the above-described first through eighth embodiments, a case has been described wherein the V-I conversion circuit is provided with a current mirror circuit unit or a current copier circuit unit, but the present invention is not limited to this, and for example, the V-I conversion circuit can comprise an operational amplifier, a resistor and a P-type transistor. In this case, the power source potential VDD is applied to the terminal on one side of the resistor, and the other terminal is connected to the source terminal of the P-type transistor. Further, the inversion input terminal of the operational amplifier is connected to the other terminal of the resistor, and the current control voltage Vc is input into the non-inversion input terminal, and the output terminal is connected to the gate terminal of the P-type transistor. Then, the drain terminal of the P-type transistor becomes the output terminal.

With a constant current circuit that a V-I conversion circuit of such configuration is provided, the current value output from the V-I conversion circuit can be adjusted by changing the resistance value of the resistors, like the constant current circuit in the semiconductor device for driving a current load device according to the above-described first through eighth embodiments, and therefore reference current can be output with high accuracy. Also, by inputting a common current control voltage Vc to all of the operational amplifiers within the constant current circuit, increase/decrease of the output current can be performed easily while keeping the current ratio that is output from the V-I conversion circuits within the constant current circuit.

What is claimed is:

1. A semiconductor device for driving a current load device comprising:

a cell having one or a plurality of current load elements;

one or a plurality of constant current circuits that output n (wherein n is a natural number) types of reference currents, each of said constant current circuit having an n number of voltage-current conversion circuits which input a current control voltage and output said reference current corresponding to said current control voltage, said current control voltage being the same as the current control voltage which is input to said voltage-current conversion circuits which belong to the same constant current circuit; and one or a plurality of drive circuits that output the current based on the reference current output from each of said constant current circuit to said cell.

2. A semiconductor device for driving a current load device according to claim 1, wherein said voltage-current conversion circuit comprises:

a transistor;

a resistor in which a reference potential is applied to the one terminal of the resistor and the other terminal is connected to said transistor; and an operational amplifier having one pair of input terminals to one of which the current control voltage is input and to the other of which is connected to the other terminal of said resistor, and an output terminal connected to the gate of said transistor;

wherein said current control voltage is input to said operational amplifier, and a current based on said current control voltage and the resistance value of said resistor is output from said transistor.

3. A semiconductor device for driving a current load device according to claim 1, wherein said voltage-current conversion circuit has a current mirror circuit, and said reference current is output from said current mirror circuit.

4. A semiconductor device for driving a current load device according to claim 3, wherein voltage-current conversion circuit further comprises:

a transistor for providing current to said current mirror circuit;

a resistor in which the one terminal of the resistor is connected to a ground and the other terminal is connected to said transistor; and an operational amplifier having one pair of input terminals to one of which the current control voltage is input and to the other of which is connected to the other terminal of said resistor, and an output terminal connected to the gate of said transistor;

wherein said current control voltage is input into said operational amplifier, and a current based on said current control voltage and the resistance value of said resistor is supplied to said current mirror circuit from said transistor.

5. A semiconductor device for driving a current load device according to claim 4, wherein said resistor is a variable resistor, and by changing the resistance value of this variable resistor, the reference current output from each block can be adjusted.

6. A semiconductor device for driving a current load device according to claim 4, wherein an offset cancel circuit for correcting the offset voltage of the input is provided to said operational amplifier.

7. A semiconductor device for driving a current load device according to claim 3, wherein said voltage-current conversion circuit further comprises:

a resistor in which the one terminal of the resistor is connected to a ground and the other terminal is connected to said current mirror circuit; and an operational amplifier having one pair of input terminals to one of which the current control voltage is input and to the other of which is connected to the other terminal of said resistor, and an output terminal connected to the gate of said current mirror circuit;

wherein said current control voltage is input into said operational amplifier, and a current based on the said current control voltage and the resistance value of said resistor flows to said current mirror circuit.

8. A semiconductor device for driving a current load device according to claim 7, wherein said resistor is a variable resistor, and by changing the value of this variable resistor, the reference current that is output from each block can be adjusted.

9. A semiconductor device for driving a current load device according to claim 7, wherein an offset cancel circuit for correcting the offset voltage of the input is provided to said operational amplifier.

10. A semiconductor device for driving a current load device according to claim 3, wherein said current mirror circuit is a cascode-type current mirror circuit.

11. A semiconductor device for driving a current load device according to claim 1, wherein said voltage-current conversion circuit has a current copier circuit, and said reference current is output from said current copier circuit.

12. A semiconductor device for driving a current load device according to claim 11, wherein said voltage-current conversion circuit further comprises:

a transistor for providing current to said current copier circuit; a resistor in which the one terminal of the resistor is connected to a ground and the other terminal is connected to said transistor; and an operational amplifier having one pair of input terminals to one of which the current control voltage is input and to the other of which is connected to the other terminal of said resistor, and an output terminal connected to the gate of said transistor;

wherein said current control voltage is input into said operational amplifier, and a current based on each of said current control voltage and the resistance value of said resistor is supplied to said current copier circuit from said transistor.

13. A semiconductor device for driving a current load device according to claim 12, wherein said resistor is a variable resistor, and by changing the resistance value of this variable resistor, the reference current output from each block can be adjusted.

14. A semiconductor device for driving a current load device according to claim 12, wherein an offset cancel circuit for correcting the offset voltage of the input is provided to said operational amplifier.

15. A semiconductor device for driving a current load device according to claim 11, wherein said voltage-current conversion circuit further comprises:

a resistor in which the one terminal of the resistor is connected to a ground and the other terminal is connected to said current copier circuit; and an operational amplifier having one pair of input terminals to one of which the current control voltage is input and to the other of which is connected to the other terminal of said resistor, and an output terminal connected to the gate of said current copier circuit;

wherein said current control voltage is input into said operational amplifier, and a current based on said current control voltage and the resistance value of said resistor flows to said current copier circuit.

16. A semiconductor device for driving a current load device according to claim 15, wherein said resistor is a variable resistor, and by changing the value of this variable resistor, the reference current that is output from each block can be adjusted.

17. A semiconductor device for driving a current load device according to claim 15, wherein an offset cancel circuit for correcting the offset voltage of the input is provided to said operational amplifier.

18. A semiconductor device for driving a current load device according to claim 11, wherein one pair of current copier circuits are provided to said voltage-current circuit, and this pair of current copier circuits performs a current recording operation and a current output operation alternately after every predetermined time period.

19. A semiconductor device for driving a current load device according to claim 11, wherein said current copier circuit is a cascode-type current copier circuit.

20. A semiconductor device for driving a current load device according to claim 1, wherein said current load device is an organic EL element.

21. A display device comprising the semiconductor device for driving a current load device according to claim 20.

* * * * *